US009950330B2

(12) United States Patent
Smith et al.

(10) Patent No.: US 9,950,330 B2
(45) Date of Patent: Apr. 24, 2018

(54) SHUT-OFF SYSTEM FOR A DISPENSER

(71) Applicant: GOJO Industries, Inc., Akron, OH (US)

(72) Inventors: David J. Smith, Brockway, PA (US); John J. McNulty, Broadview Heights, OH (US); Robert Quinlan, Stow, OH (US); Christopher J. Mann, Akron, OH (US); James M. Yates, Akron, OH (US)

(73) Assignee: GOJO Industries, Inc., Akron, OH (US)

( * ) Notice: Subject to any disclaimer, the term of this patent is extended or adjusted under 35 U.S.C. 154(b) by 175 days.

(21) Appl. No.: 14/611,803

(22) Filed: Feb. 2, 2015

(65) Prior Publication Data

US 2015/0144659 A1 May 28, 2015

Related U.S. Application Data

(62) Division of application No. 13/181,083, filed on Jul. 12, 2011, now Pat. No. 8,991,648.

(51) Int. Cl.

| | |
|---|---|
| ***A47K 5/00*** | (2006.01) |
| ***B05B 11/00*** | (2006.01) |
| ***A47K 5/12*** | (2006.01) |

(52) U.S. Cl.

CPC ..... *B05B 11/303* (2013.01); *A47K 5/1208* (2013.01); *B05B 11/0027* (2013.01);

(Continued)

(58) Field of Classification Search

CPC ..... B05B 11/303; B05B 11/0027; B05B 11/3094; B05B 11/0064; B05B 11/0072;

(Continued)

(56) References Cited

U.S. PATENT DOCUMENTS 3,768,704 A * 10/1973 Beguin ..... B65D 35/56 222/207
3,815,794 A * 6/1974 Carlisle ..... B65D 75/5822 222/107

(Continued)

FOREIGN PATENT DOCUMENTS

| | | |
|---|---|---|
| EP | 0383618 A1 | 8/1990 |
| GB | 1261815 | 1/1972 |

(Continued)

OTHER PUBLICATIONS

Mexican Office Action cited in Mexican Application No. MX/a/2014/000410 dated Aug. 14, 2017, 3 pgs.

(Continued)

*Primary Examiner* — Charles P Cheyney

(74) *Attorney, Agent, or Firm* — Cooper Legal Group, LLC

(57) ABSTRACT

A shut-off system for a dispenser includes a pinch member that moves relative to a guide and which is normally biased against a flexible outlet tube that is disposed therebetween. The flexible outlet tube that carries material, such as soap, supplied from a pump to an outlet nozzle. The pump and the pinch member are in operative engagement with an actuator, such that when the actuator is not engaged, the pinch member closes the outlet tube to prevent residual material retained in the outlet tube from flowing or drooling out of the outlet nozzle. Correspondingly, when the actuator is engaged, the pump is compressed, and the pinch member is moved away from the outlet tube, allowing the material to be pumped through the outlet tube and dispensed from the outlet nozzle.

20 Claims, 20 Drawing Sheets

(52) U.S. Cl.
CPC ..... *B05B 11/3094* (2013.01); *B05B 11/0064* (2013.01); *B05B 11/0072* (2013.01)

(58) Field of Classification Search
CPC ..... A47K 5/1215; A47K 5/1208; Y10T 137/7904
USPC ..... 222/96, 212, 213, 214, 207, 577, 222/544–563, 105, 181.3, 181.2, 95.207
See application file for complete search history.

(56) References Cited

U.S. PATENT DOCUMENTS 4,256,242 A * 3/1981 Christine ..... G01F 11/088 222/207
4,475,683 A * 10/1984 Vogt ..... B65D 77/14 222/541.9
4,564,127 A * 1/1986 Garabedian ..... A47K 5/1215 222/105
4,932,562 A * 6/1990 Christine ..... A47K 5/1215 137/844
4,946,072 A * 8/1990 Albert ..... A47K 5/1217 222/105
5,507,355 A 4/1996 Mattsson
6,132,407 A * 10/2000 Genese ..... A61F 5/4405 222/559
6,261,254 B1 * 7/2001 Baron ..... A61F 5/4407 604/317
6,540,110 B2 * 4/2003 Weiser ..... A47K 5/1215 222/103
8,328,457 B2 * 12/2012 Werth ..... A61M 39/1011 24/16 R

FOREIGN PATENT DOCUMENTS

JP H0324 A 1/1991
JP 2009-505682 A 2/2009
KR 10-2009-0099803 9/2009
KR 20090099803 9/2009
WO 01/34485 A1 5/2001
WO 2006/119163 A1 11/2006

OTHER PUBLICATIONS

Japanese Office Action cited in Japanese Application No. 2016-206145 dated Sep. 6, 2017, 7 pgs.
EP Search Report cited in EP Application No. 17185265.0 dated Dec. 11, 2017, 8 pgs.

* cited by examiner

SHUT-OFF SYSTEM FOR A DISPENSER

CROSS-REFERENCE TO RELATED APPLICATION

This is a divisional application of U.S. patent application Ser. No. 13/181,083 filed Jul. 12, 2011, the content of which is incorporated herein by reference.

TECHNICAL FIELD

The present invention generally relates to dispensers, such as soap dispensers. Particularly, the present invention relates to shut-off systems for a dispenser to prevent material from subsequently drooling therefrom when the dispenser is not in use. More particularly, the present invention relates to a shut-off system for a dispenser that compresses an outlet tube when the dispenser is not in use to prevent drooling of material therefrom.

BACKGROUND OF THE INVENTION

Liquid dispensers, such as soap and sanitizer dispensers, are configured to provide a user with an amount of liquid material upon the actuation of the dispenser. Many liquid dispensers use dome pumps that provide a compressible void that receives the liquid material from a replaceable refill container. Correspondingly, when the dispenser is actuated the dome pump is engaged, or otherwise compressed, whereupon the material within the void is pushed out and dispensed through an outlet tube for delivery at a dispensing nozzle. Simultaneously, with the dispensing of the material, a low pressure region is formed within the void of the dome pump, causing new material from the refill container to be drawn into it. As such, the operation of the dome pump ensures that there is a continuous amount of material ready to be dispensed from the dispensing nozzle upon the compression of the dome pump.

While current dome pumps utilized by dispensers provide acceptable dispensing performance, it lacks a system to prevent residual material retained in the outlet tube from inadvertently drooling or otherwise leaking out of the dispensing nozzle. Such drooling occurs primarily due to the viscosity of the material being dispensed, the temperature of the material (which becomes more viscous with increased temperature), and the operation of gravity. In addition, drooling results in a substantial amount of wasted material, which increases operating costs, as such dispensers require more frequent refill container replacement. The drooled material also results in an unwanted mess in the region where the dispenser is mounted, such as on countertops and the floor. In some cases, the drooled material may create slippery areas on the floor beneath the dispenser, creating a slip hazard to those walking thereabout.

Therefore, there is a need for a shut-off system for a dispenser to prevent residual material from drooling out of a dispensing nozzle. In addition, there is a need for a shut-off system for a dispenser that is simple to implement. Moreover, there is a need for a shut-off system for a dispenser that is low-cost. Still yet that is a need for a shut-off system for a dispenser that can be retro-fit to an outlet tube provided by a pump assembly, such as a dome pump assembly.

SUMMARY OF THE INVENTION

In light of the foregoing, it is a first aspect of the present invention to provide a dispenser to dispense material from a refill container comprising a frame; a pump attached to said frame, said pump having an inlet adapted to be fluidly coupled to the refill container to allow said pump to receive material therefrom, said pump coupled to an outlet nozzle by an outlet tube; a guide attached to said frame; a pinch member movably attached to said guide, wherein said outlet tube is disposed between said guide and said pinch member; at least one biasing member to normally bias said pinch member to a position to compress said outlet tube closed; and an actuator movably coupled to said frame and configured to engage said pinch member prior to the engagement of said pump when said actuator is engaged; wherein as said actuator is engaged, said pinch member is moved from its normally biased position to open said outlet tube, while said pump is engaged to dispense material through said outlet tube and out of said outlet nozzle.

It is another aspect of the present invention to provide a method of dispensing material from a container comprising providing a dispenser having a spring-biased pinch member that moves relative to a guide, and which is normally biased against, said dispenser including a pump to dispense material from an outlet tube that is disposed between said base member and said pinch member, said dispenser including an actuator in operative engagement with said pump and said pinch member; biasing said pinch member to compress said outlet tube; moving said actuator; moving said pinch member away from said outlet tube; engaging said pump; dispensing material from said outlet tube; releasing said actuator; and moving said pinch member to compress said outlet tube.

Yet a further aspect of the present invention is to provide a dispenser to dispense material comprising a pump having an inlet adapted to receive material, and an outlet; an outlet tube in fluid communication with said outlet, said outlet tube having an outlet nozzle; and a clip attached to said outlet tube, an engagement arm extending from said clip biased to compress said outlet tube; wherein when said pump is compressed, the pressurized material urges said engagement arm away from said outlet tube to allow material to be dispensed therethrough and out of said outlet nozzle.

Another aspect of the present invention is to provide a dispenser to dispense a material from a refill container comprising a frame; a pump attached to said frame, said pump having an inlet adapted to be fluidly coupled to the refill container to allow said pump to receive material therefrom, said pump coupled to an outlet nozzle by an outlet tube; an actuator movably coupled to said frame and configured to engage said pump when said actuator is engaged; a magnet disposed in a first portion of said outlet tube; and a ferromagnetic section disposed in a second portion of said outlet tube, wherein said magnet and said ferromagnetic section are normally attracted to each other to close said outlet tube; wherein when said actuator is engaged, said pump pressurizes the material to open said outlet tube to dispense material from said outlet nozzle.

It is yet a further aspect of the present invention to provide a dispenser to dispense material from a refill container comprising a pump having an inlet adapted to receive material, and an outlet; an outlet tube in fluid communication with said outlet, said outlet tube having an outlet nozzle; and a clip having a base section carrying a magnet and a cap section carrying a ferromagnetic section, said outlet tube disposed between said base and cap sections, such that said magnet and said ferromagnetic sections are normally attracted to each other to compress said outlet tube closed; wherein when said pump is compressed, said pump pressurizes the material to open said outlet tube to dispense material from said outlet nozzle.

BRIEF DESCRIPTION OF THE DRAWINGS

These and other features and advantages of the present invention will become better understood with regard to the following description, appended claims and accompanying drawings where:

DETAILED DESCRIPTION OF THE INVENTION

Figure 1:
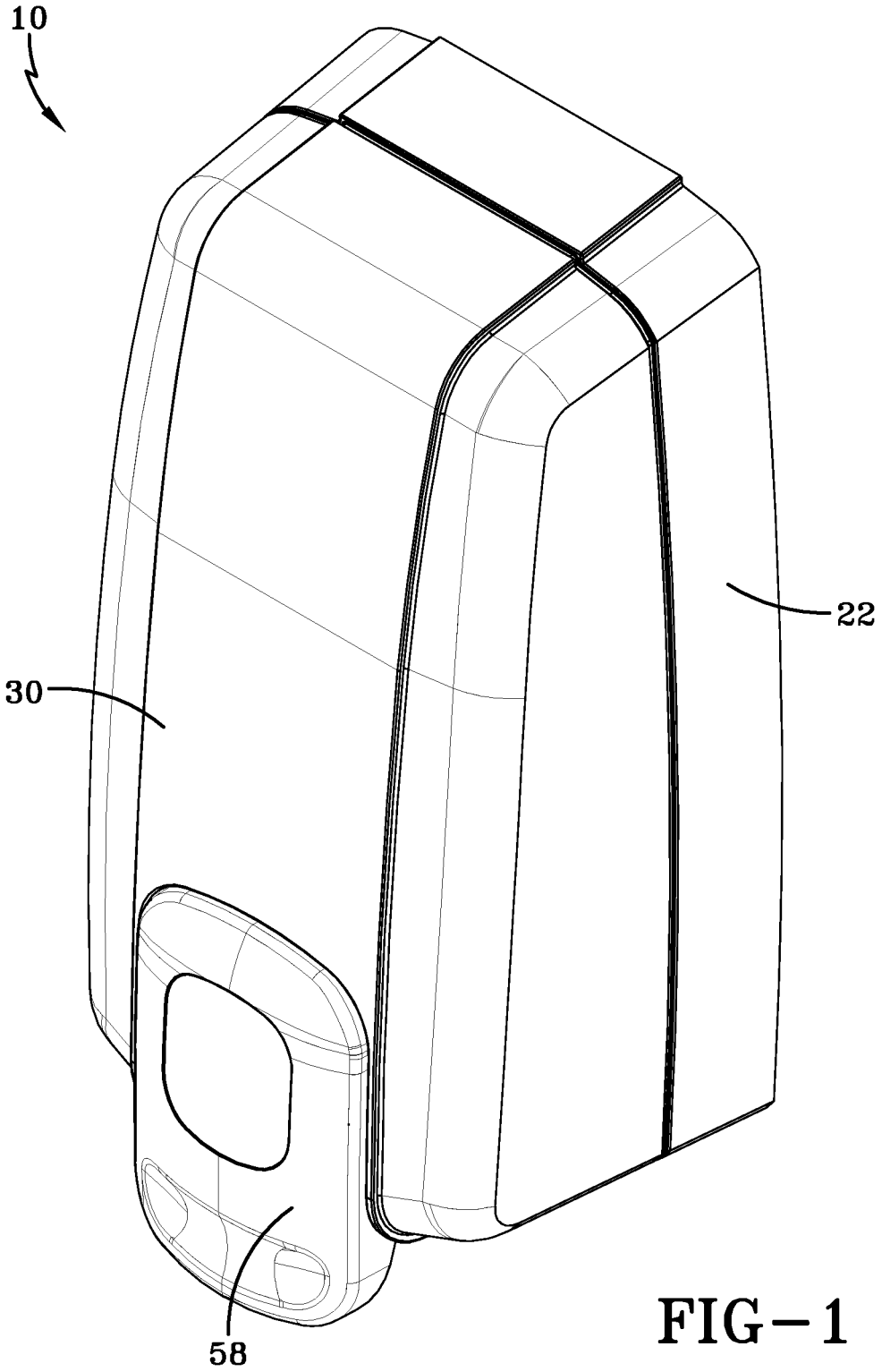
FIG. 1 is a perspective view of a shut-off system for a dispenser using a pinch bar shut-off assembly in accordance with the concepts of the present invention.
Figure 2:
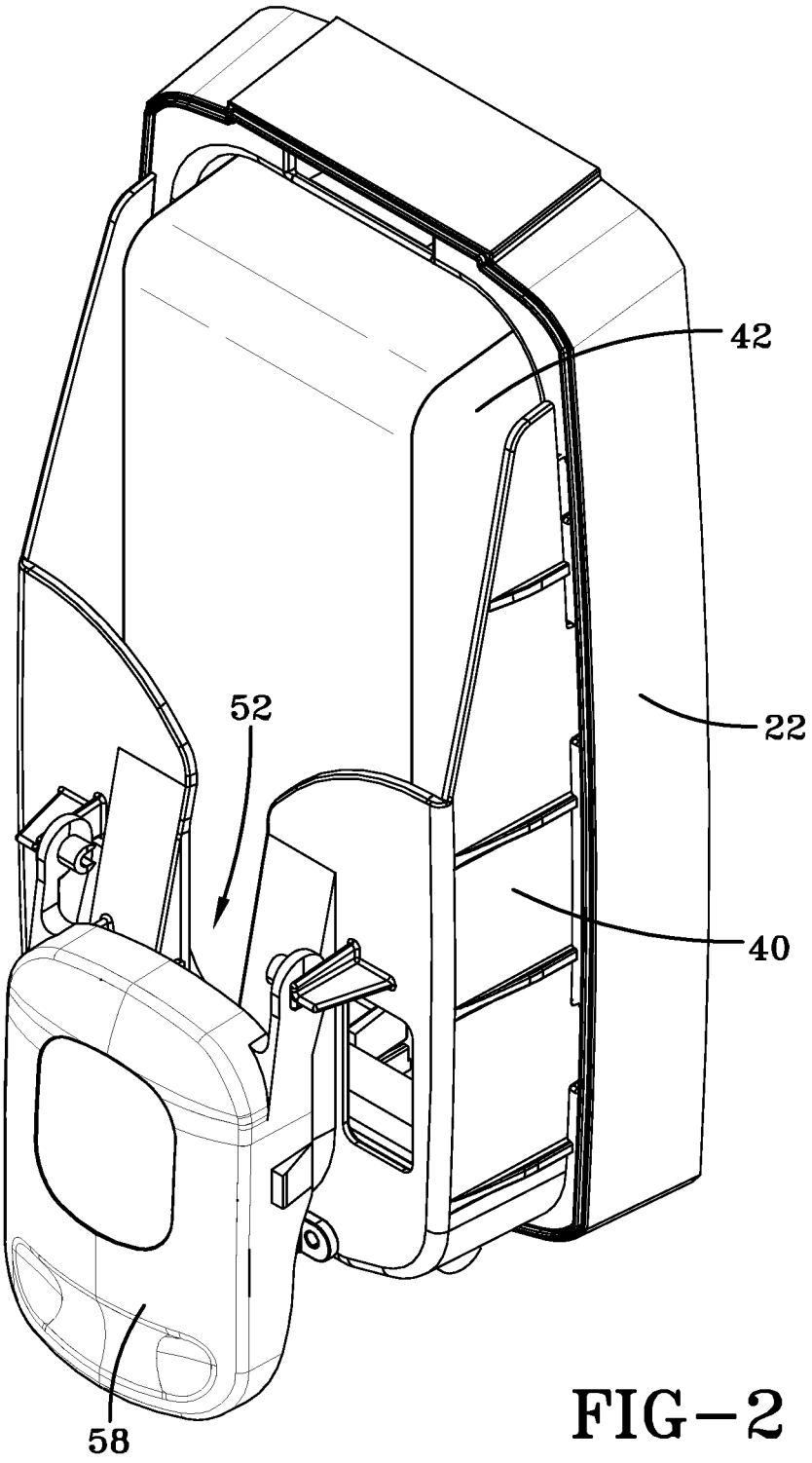
FIG. 2 is a perspective view of the dispenser with its cover removed to show an actuator used to initiate the dispensing of material from the dispenser in accordance with the concepts of the present invention.
Figure 3:
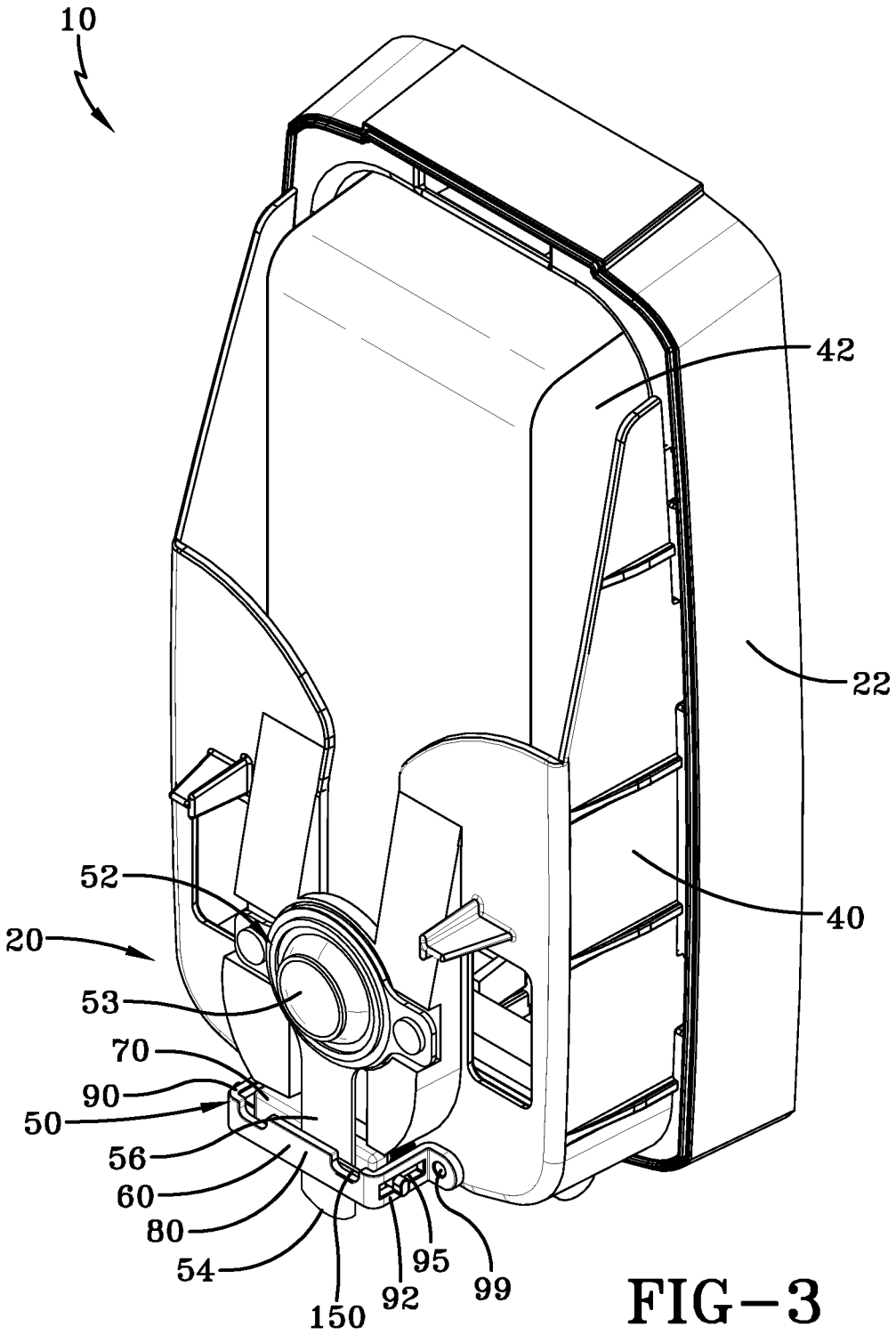
FIG. 3 is a perspective view of the dispenser with its cover and actuator removed to show the pinch bar shut-off assembly in accordance with the concepts of the present invention.

A shut-off system for a dispenser 10 is generally referred to by the numeral 20, as shown in FIGS. 1-11 of the drawings. The dispenser 10 provides a backplate 22 that allows the dispenser 10 to be attached to any suitable support structure, such as a wall for example. Removably coupled to the backplate 22 is a cover 30 that provides access to the internal components of the dispenser 10, such as a retaining plate or frame 40, shown in FIGS. 2 and 3. The retaining plate 40 serves to retain a removable or fixed refill container 42 within the dispenser 10, while also serving as an attachment point for a pinch bar assembly 50 provided by the shut-off system 20. Liquid material, such as soap, sanitizer, or moisturizer is dispensed from the refill container 42 by a pump assembly 52 that is mounted to the retaining plate 40 using any suitable means of fixation, such as removable means, including pins, tabs, or the like.

The pump assembly 52 includes a pump 53, such as a dome pump, that is fluidly coupled to an outlet nozzle 54 by a flexible outlet tube 56 that is routed so as to be in operative engagement with a pinch bar assembly 50. The pump 53 also includes an inlet 57 that is configured to be fluidly coupled to the refill container 42 so as to receive liquid material therefrom. The pump assembly 52 also includes an actuator 58 that is pivotably attached to the mounting plate 40 and is configured to physically engage the pump 53 and the pinch bar assembly 50 in a manner to be discussed. As such, when the actuator 58 is engaged, the pump 53 is compressed and the pinch bar assembly 50 is disengaged from the outlet tube 56 allowing liquid material from the refill container 42 to be freely dispensed. Alternatively, when the actuator 58 is in its normal position, the pump 53 is not compressed, and the pinch bar assembly 50 compresses the outlet tube 54, closing it to prevent residual material in the outlet tube 56 and pump 53 from drooling out of the outlet nozzle 56. However, while the pinch bar shut-off assembly 50 is shown used with a manually-actuated dispenser 10, it should be appreciated that it may be used with motorized dispensers which include a flexible outlet tube 56.

Figure 4A:
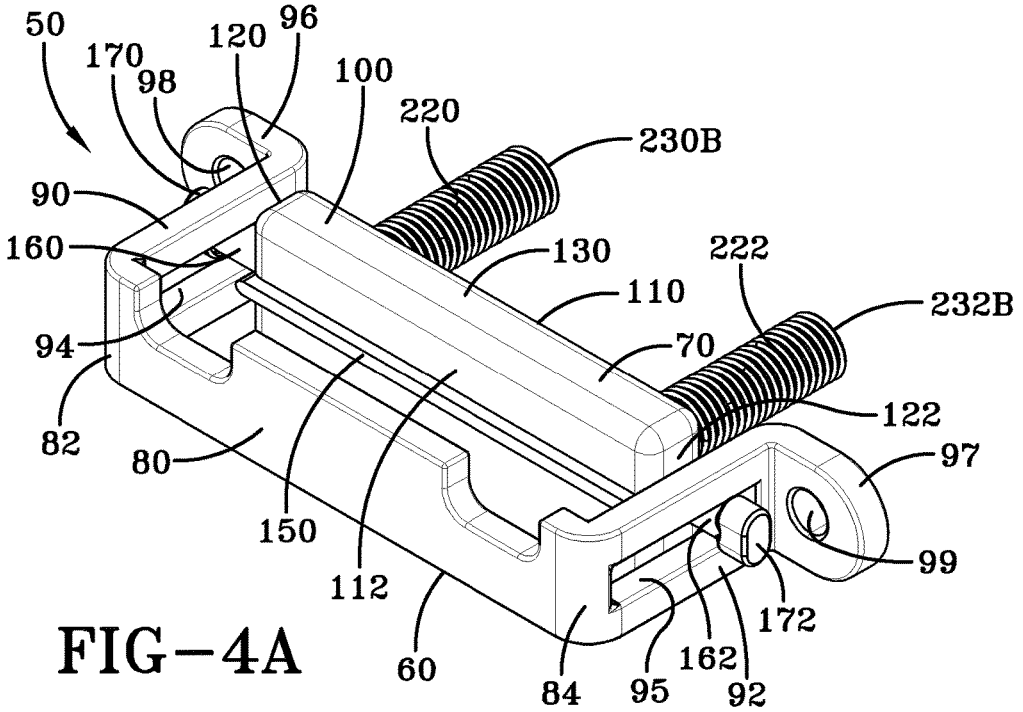
FIG. 4A is a perspective view of a front portion of the pinch bar shut-off assembly in accordance with the concepts of the present invention.
Figure 4B:
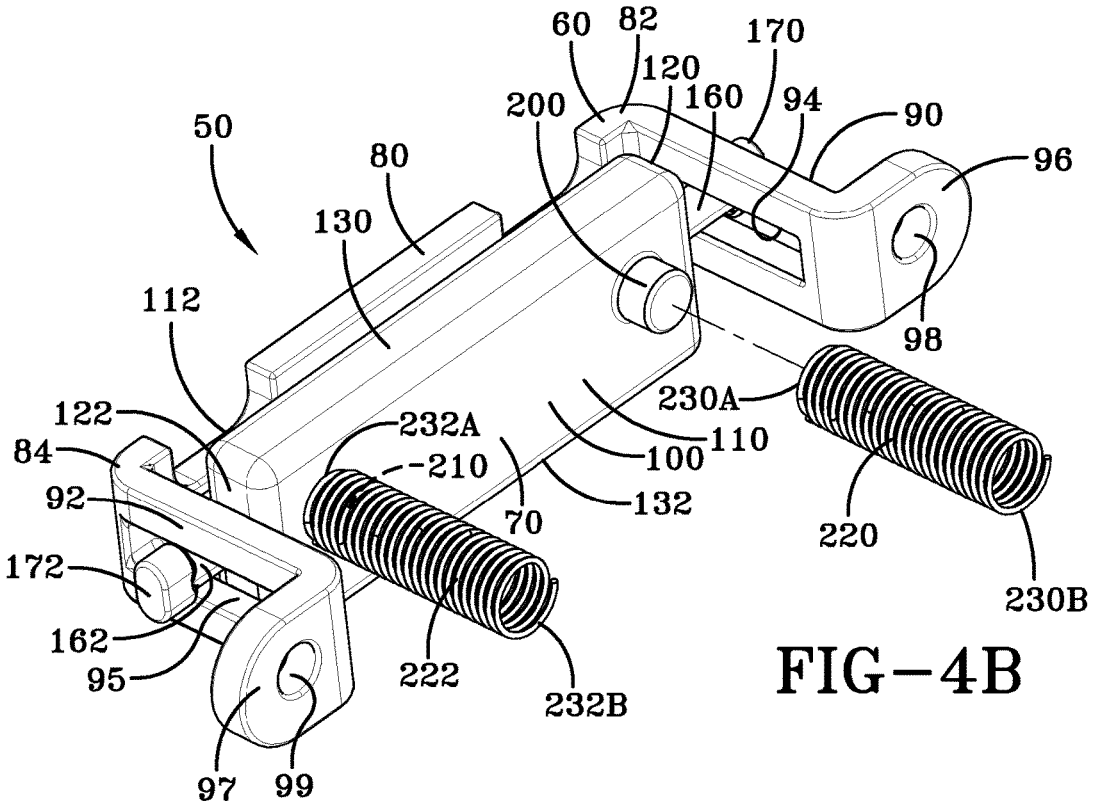
FIG. 4B is a perspective view of a rear portion of the pinch bar shut-off assembly in accordance with the concepts of the present invention.
Figure 5:
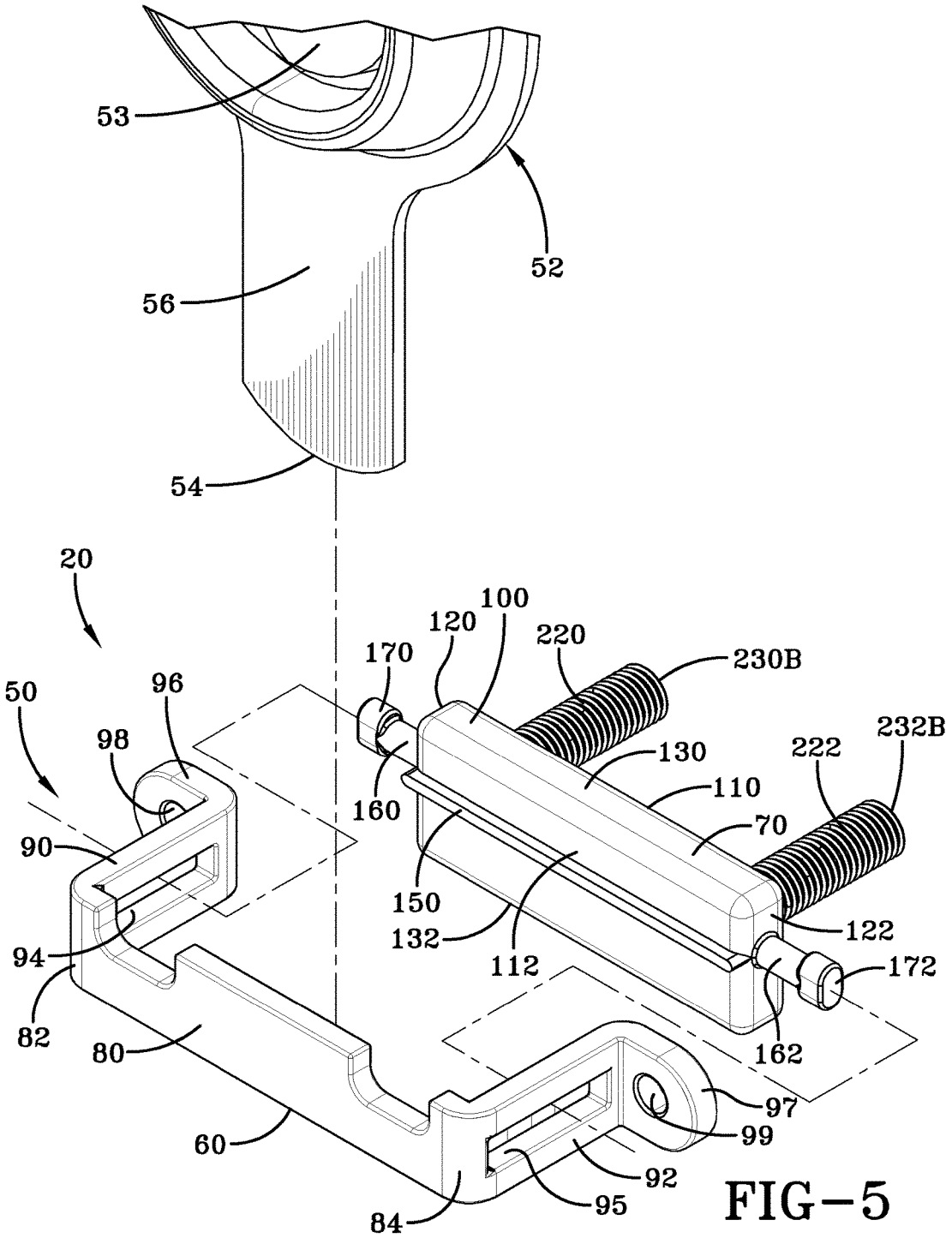
FIG. 5 is an exploded view of the pinch-bar assembly in accordance with the concepts of the present invention.

Referring to FIGS. 4A-B and FIG. 5, the pinch bar shut-off assembly 50 comprises a guide 60 and a pinch member 70. The guide 60 includes a primary section 80 having ends 82 and 84 at which respective support arms 90 and 92 extend at a substantially right angle therefrom. Disposed through each support arm 90,92 are respective guide slots 94 and 95. In order to attach the guide 60 to the retaining member 42 of the dispenser 10, each support arm 90,92 includes a respective attachment tab 96,97 having respective attachment apertures 98 and 99 disposed therethrough. The attachment apertures 97,98 are configured to receive any suitable fastener, such as a screw or rivet, for example, although the guide 60 may be configured to be attached to the retaining member 42 using any suitable means of fixation, such as adhesive, thermowelding, or the like. It should also be appreciated that the guide 60 may be formed of any suitable material, such as plastic or metal.

The pinch member 70 comprises an elongated body 100 having inner and outer surfaces 110 and 112, and is bounded by lateral edges 120,122 and upper and lower edges 130 and 132. While the body 100 is shown as having a substantially rectangular shape in the Figs., it should be appreciated that it may take on any suitable shape, such as a curvilinear shape, a rectilinear shape, or a combination of both. Extending from the outer surface 112 of the pinch member 70 at a substantially right angle is an engagement ridge or wall 150. In addition, a pair of spaced guide arms 160 and 162 also extends from respective lateral edges 120,122 along the longitudinal axis of the pinch member 70.

The pinch member 70 also includes retaining members 170,172 that extend from respective guide arms 160,162 to retain the pinch member 170 to the guide 60. The retaining members 170,172 are configured as elongated structures that are dimensioned to have a dimension that is receivable through the guide slots 94,96 and a dimension when rotated relative to the guide slots 94,96 that is not receivable through the guide slots 94,96. That is, when the pinch member 70 is rotated relative to the guide slots 94 and 96, such that the longitudinal axis of the elongated retaining members 170 and 172 is parallel to the guide slots 94,96, the retaining members 170,172 are permitted to be received therethrough. Next, when the retaining members 170,172 are received within the guide slots 94,96, the pinch member 70 is rotated such that the longitudinal axis of the elongated retaining members 170,172 is substantially perpendicular to the longitudinal axis or path of travel provided by the guide slots 94,96, such that the wall 150 is substantially opposite the primary section 80 of the guide 60. As such, the pinch bar 70 is permitted to slide back and forth along the guide slots 94,96 via the guide arms 160,162, while the retaining members 170,172, which are disposed adjacent to the outer surface 110 of the support arms 90,92, prevent the pinch member 70 from becoming unattached from the guide 60, the pinch member 70 is attached to the guide 60 by sliding the retaining members 170,172 through the respective guide slots 94,96, such that the retaining members 170,172 are adjacent to the outer surface 110 of the respective support arms 90,92, while the guide arms 160,162 are disposed within respective guide slots 94,96.

Extending from the inner surface 110 of the pinch member 70 at a substantially right angle is a pair of spaced attachment protrusions 200 and 210. The attachment protrusions 200,210 are dimensioned to be attached to respective biasing members, such as springs 220 and 222. Specifically, the springs 220,222 include opposed ends 230A-B and 232A-B and are attached to the pinch member 70, such that ends 230A and 232A of respective springs 220,222 are attached to respective protrusions 200,210, while the other ends 230B,232B are received within respective retaining apertures 240 and 242 that are disposed in the retaining member 40. Thus, the pump assembly 52 is attached to the retaining plate 40, such that the outlet tube 56 is placed between the primary section 80 of the guide 60 and the outer surface 112 of the pinch member 70. As such, the springs 220,222 normally urge the pinch member 70 against the outlet tube 56, such that the wall 150 compresses the outlet tube 56 to prevent residual liquid material therein from drooling or otherwise leaking from the outlet nozzle 54 when the dispenser 10 is not in use.

Figure 6:
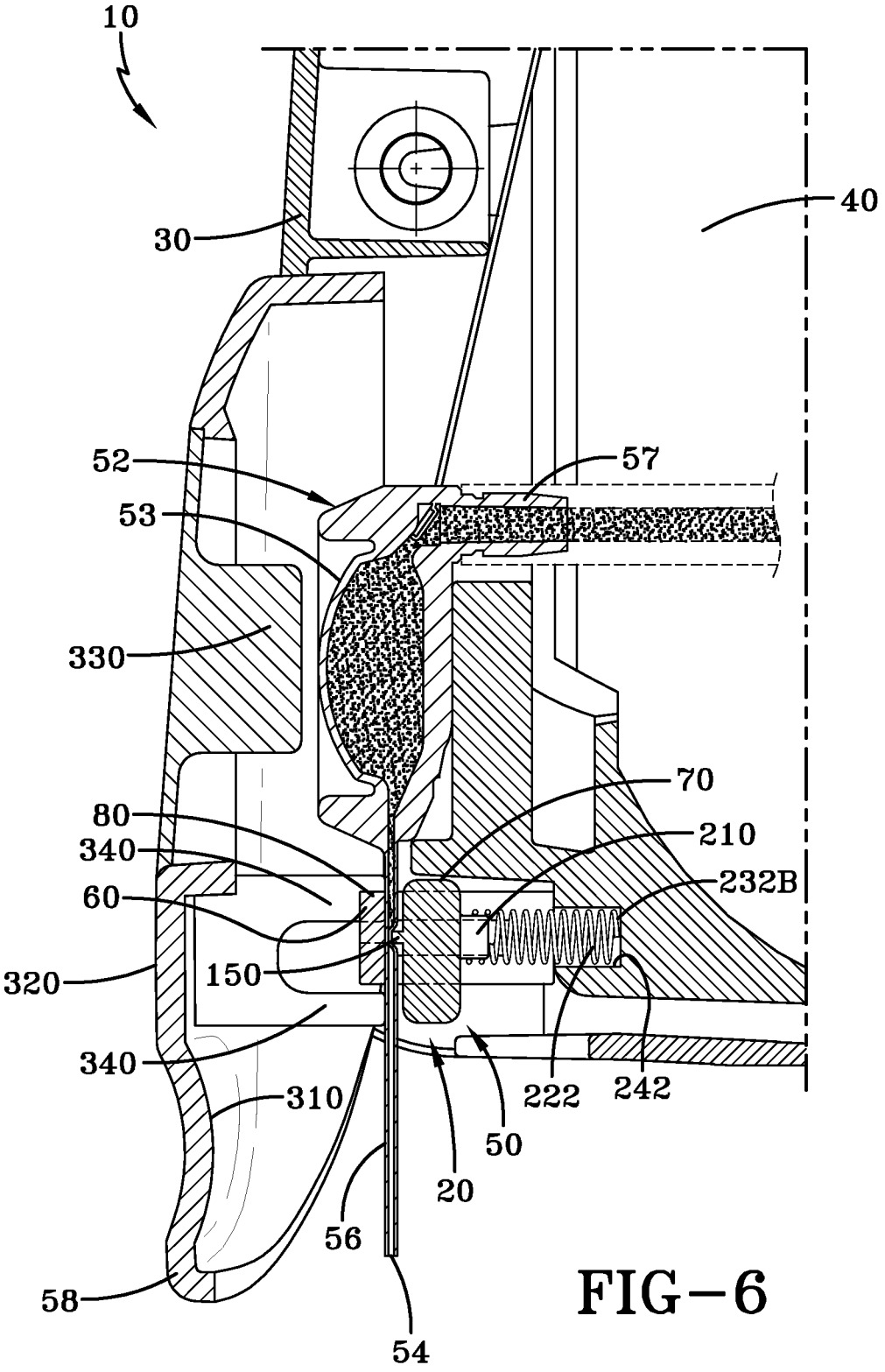
FIG. 6 is a cross-sectional view of the dispenser showing an actuator in its normal resting position in accordance with the concepts of the present invention.
Figure 7:
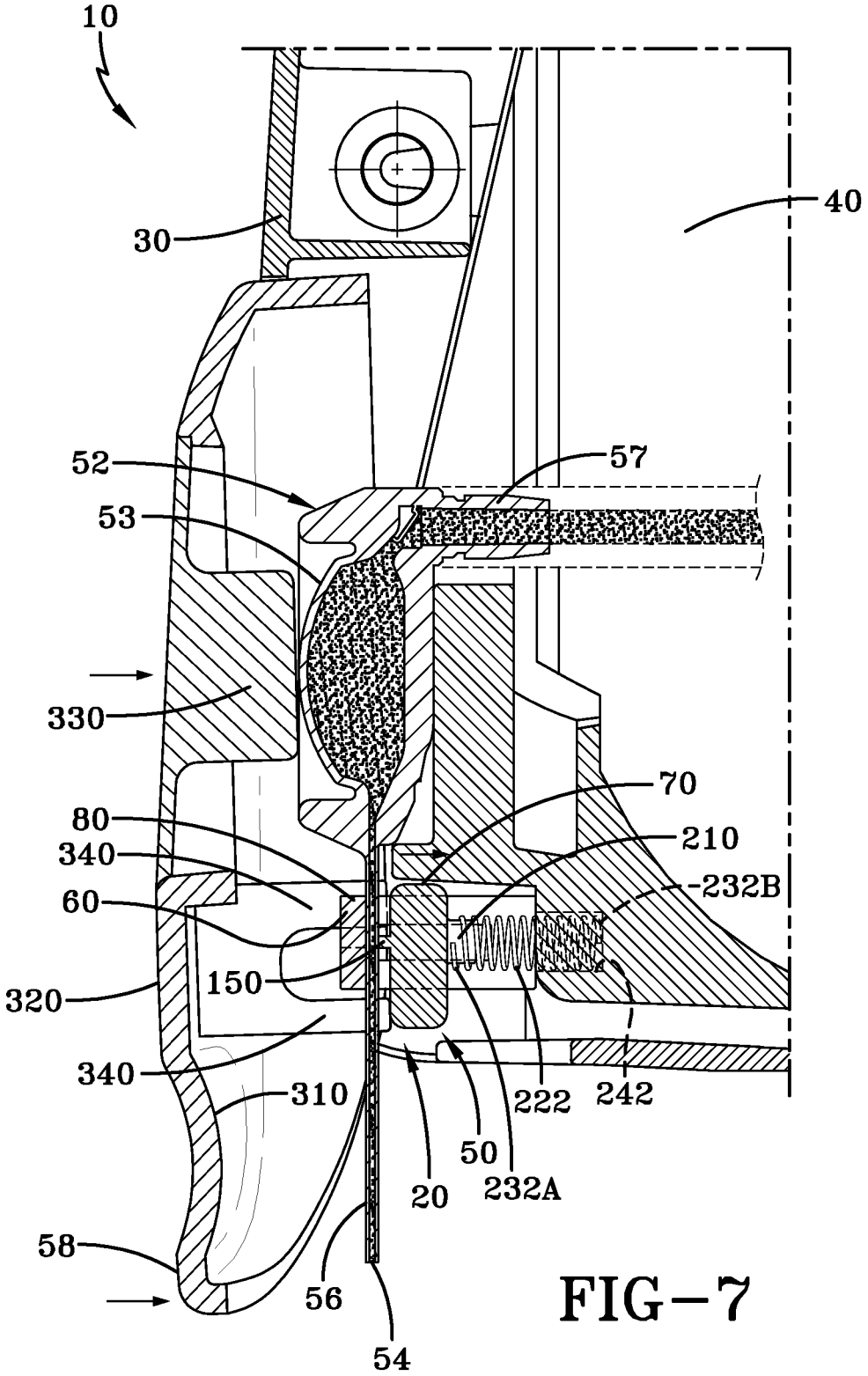
FIG. 7 is a cross-sectional view of the dispenser showing the actuator being engaged by a user to dispense material therefrom in accordance with the concepts of the present invention.
Figure 8:
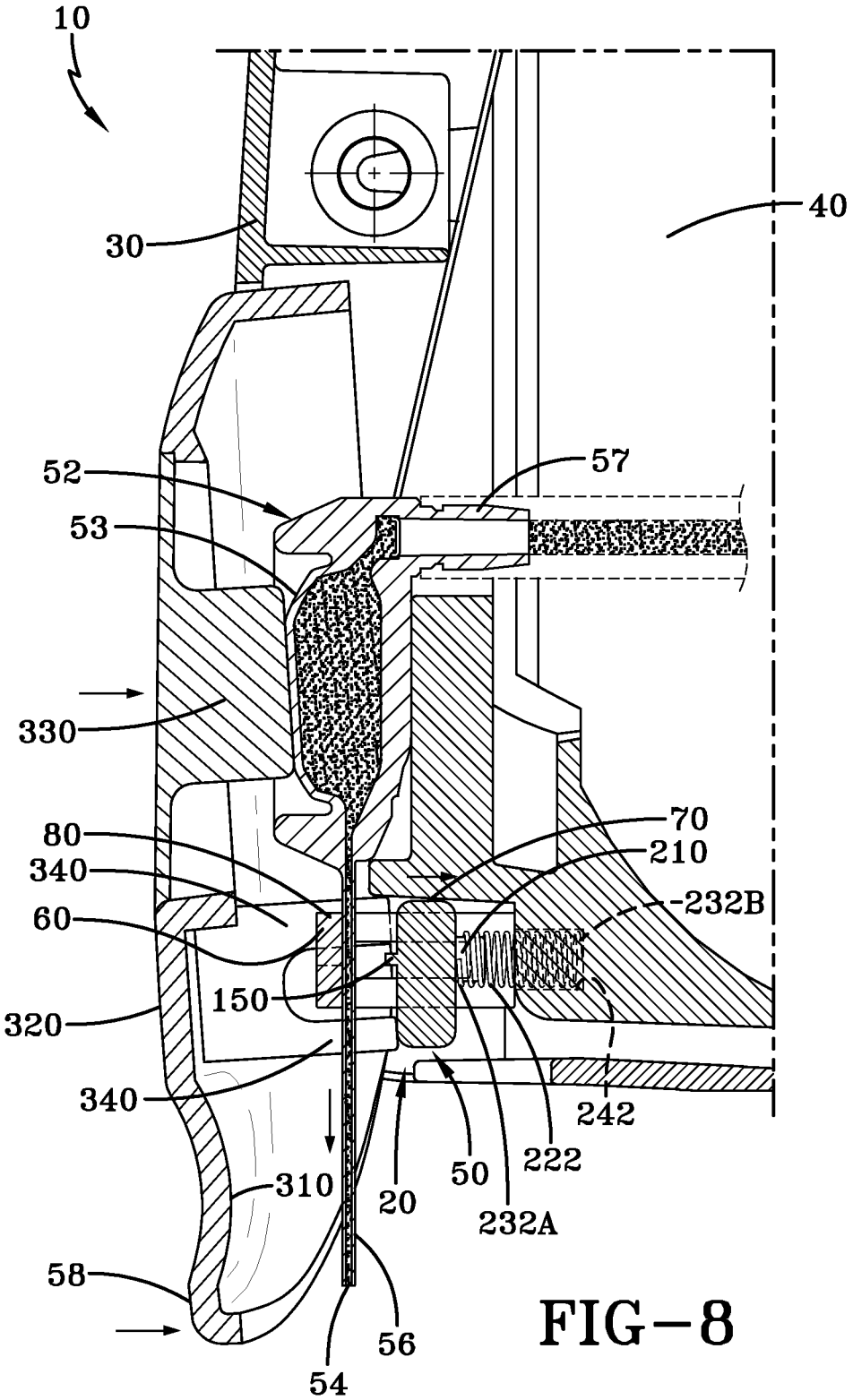
FIG. 8 is a cross-sectional view of the dispenser showing the partial compression of the dome pump and the partial release of the pinch member from an outlet tube as the actuator is further engaged in accordance with the concepts of the present invention.

The actuator 58, which is pivotably attached to the mounting member 40 of the dispenser 10 includes inner and outer surfaces 310 and 320 with spaced upper and lower engagement ribs 330 and 340 extending from the inner surface 310, as shown in FIGS. 6-11. The upper engagement rib 330 is configured to operatively engage the dome pump 53, while the lower engagement rib 340 is configured to operatively engage the movable pinch member 70. Specifically, the upper engagement rib 330 and lower engagement rib 340 are dimensioned such that the lower engagement rib 340 operatively engages the movable pinch member 70 before or prior to the upper engagement rib 330 operatively engaging the dome pump 250 when the actuator 58 is depressed, as shown in FIGS. 7-8. Such a configuration of the upper and lower engagement ribs 330,340 ensures that the compression normally applied to the outlet tube 56 by the pinch member 70 is released before the pump 53 is compressed to pump liquid material through the outlet tube 56 for dispensing at the nozzle 54.

Figure 9:
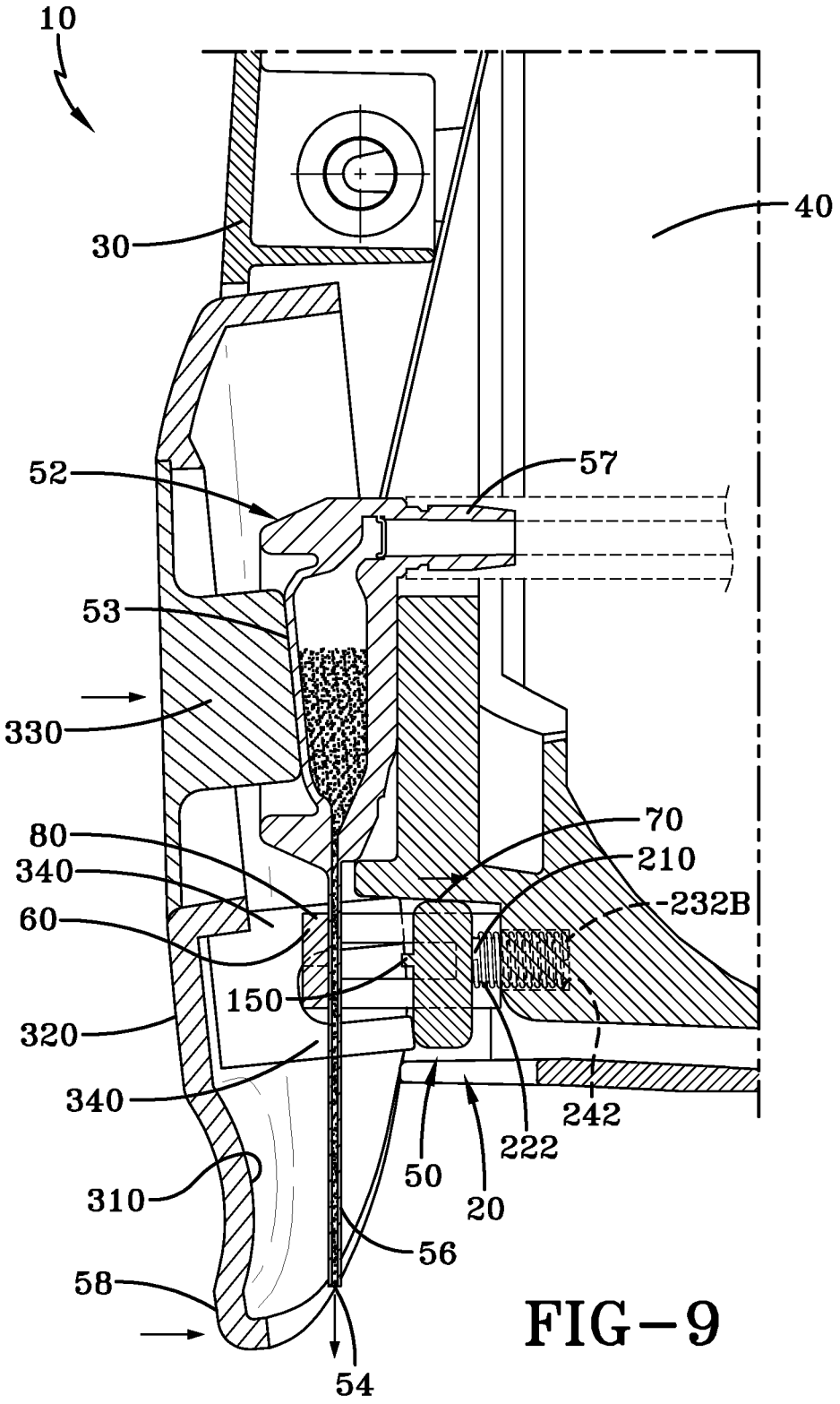
FIG. 9 is a cross-sectional view of the dispenser showing the dome pump fully compressed and the pinch member fully released from the outlet tube, so as to dispense material therefrom as the actuator is fully engaged in accordance with the concepts of the present invention.
Figure 10:
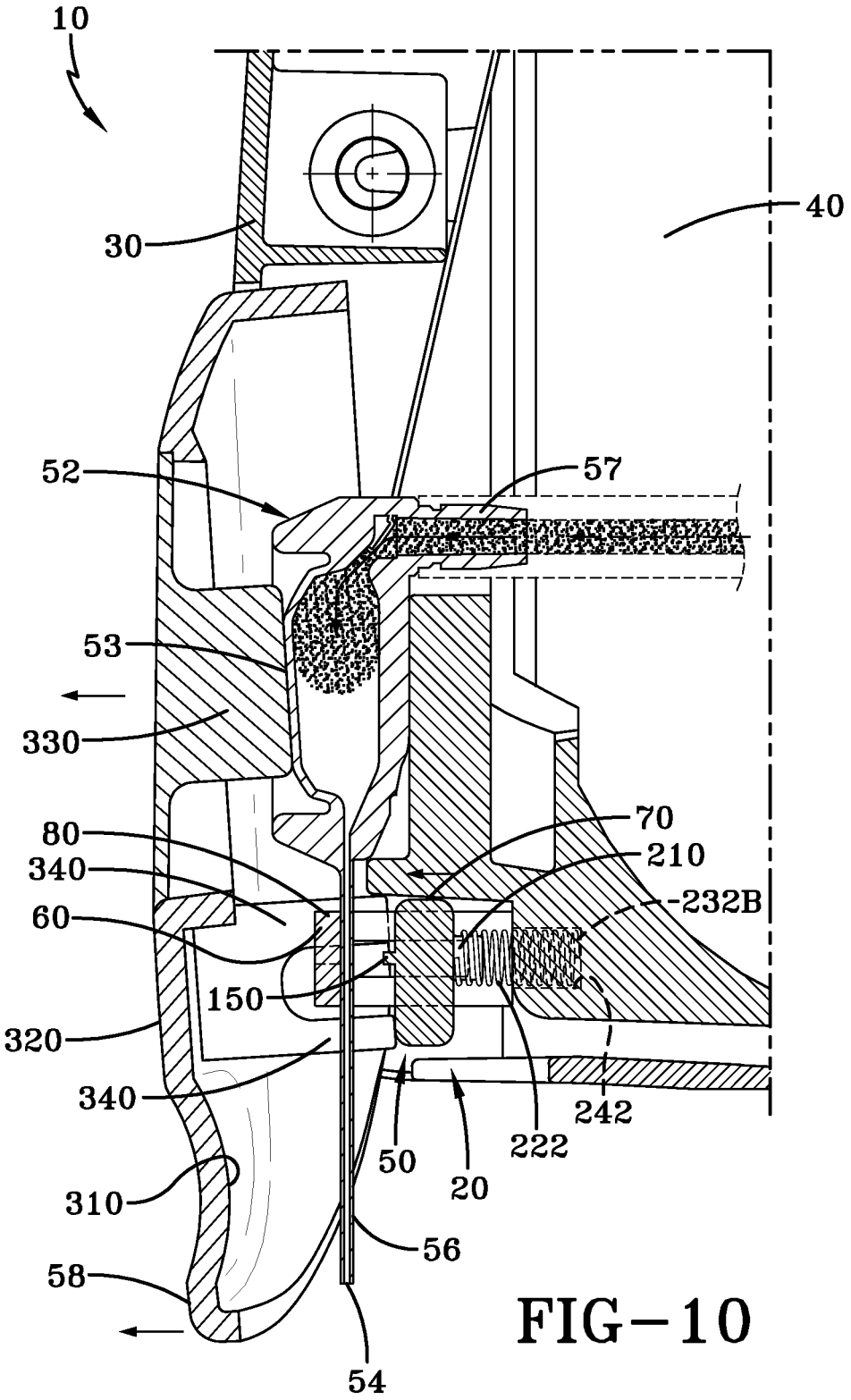
FIG. 10 is a cross-sectional view of the dispenser showing the dome pump drawing in material from a refill container after the actuator has been released in accordance with the concepts of the present invention.
Figure 11:
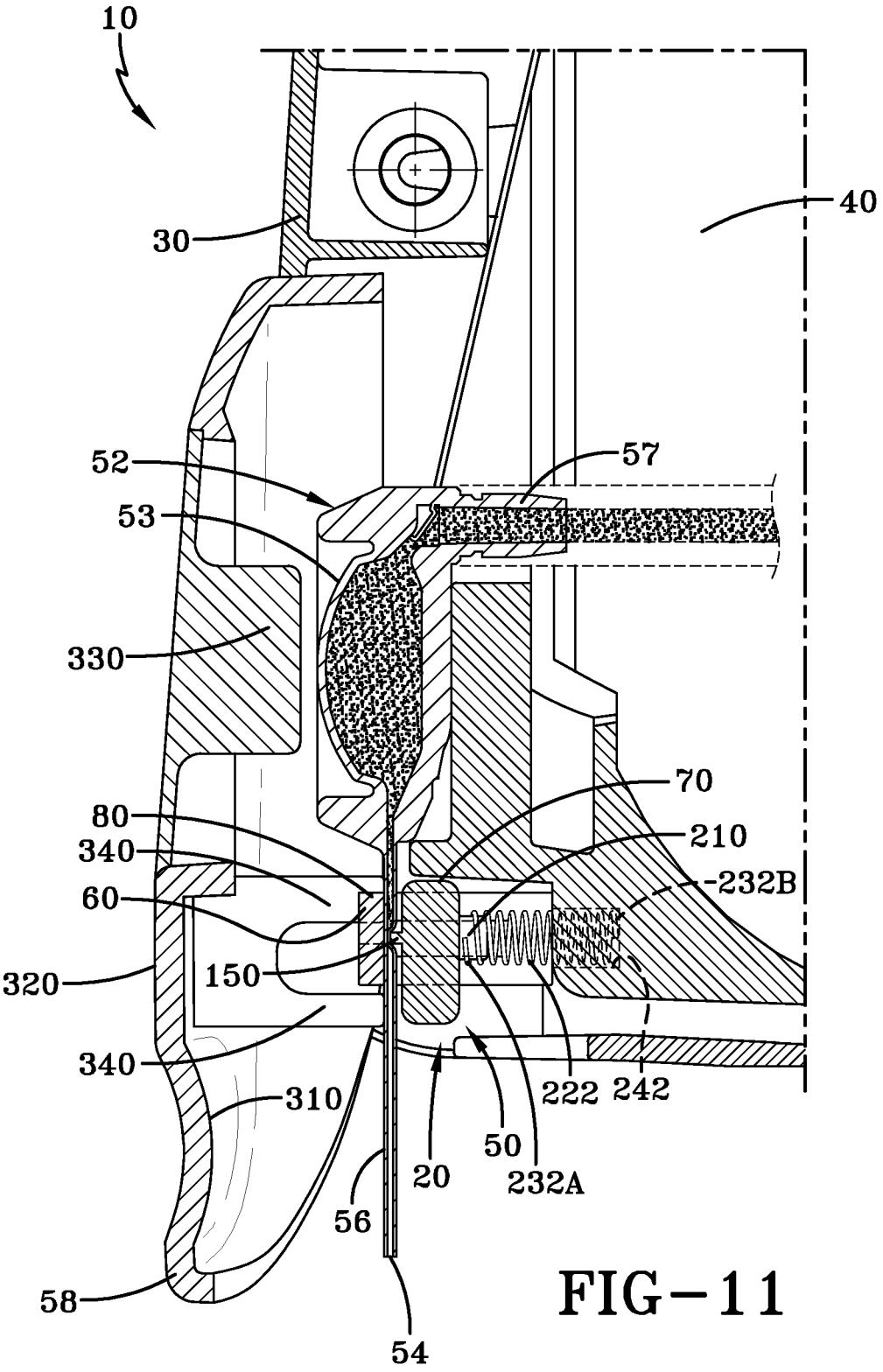
FIG. 11 is a cross-sectional view of the dispenser showing the dome pump filled with material and the pinch member engaging the outlet tube to prevent the drooling of material out of the dome pump in accordance with the concepts of the present invention.

Thus, during operation of the dispenser 10, the actuator 58 is in its normally resting position, as shown in FIG. 6, whereby the upper and lower engagement ribs 330,340 are not actively engaging or otherwise compressing the pump 53 and pinch member 70. As such, the pinch member 70 is placed in its normally biased position, whereby it is urged by the springs 220,222 to compress the outlet tube 56 closed. However, when the user engages or otherwise presses the actuator 58, the upper engagement rib 330 begins to compress the dome pump 53, while the lower engagement rib 340 begins to move the pinch member 70 away from the primary section 80 of the guide 60 to allow the outlet tube 56 to be opened, as shown in FIGS. 7-9. Once the dome pump 53 has been sufficiently compressed and the pinch member 70 has been sufficiently moved or retracted away from the outlet tube 56 liquid material is forced through the outlet tube 56 for dispensing out of the outlet nozzle 54. Once the material is dispensed and the actuator 58 is released by the user, as shown in FIGS. 10 and 11, the upper engagement rib 330 is disengaged from the respective dome pump 53, while the lower engagement rib 340 allows the springs 220,222 to push or urge the pinch member 70 back against the outlet tube 56, such that it is compressed between the primary section 80 of the guide 60, so as to close-off the outlet tube 53. Moreover, as the upper engagement rib 330 is disengaged against the pump 53, new material from the refill container 42 is drawn into the pump 53 to be dispensed during subsequent actuations.

Figure 12:
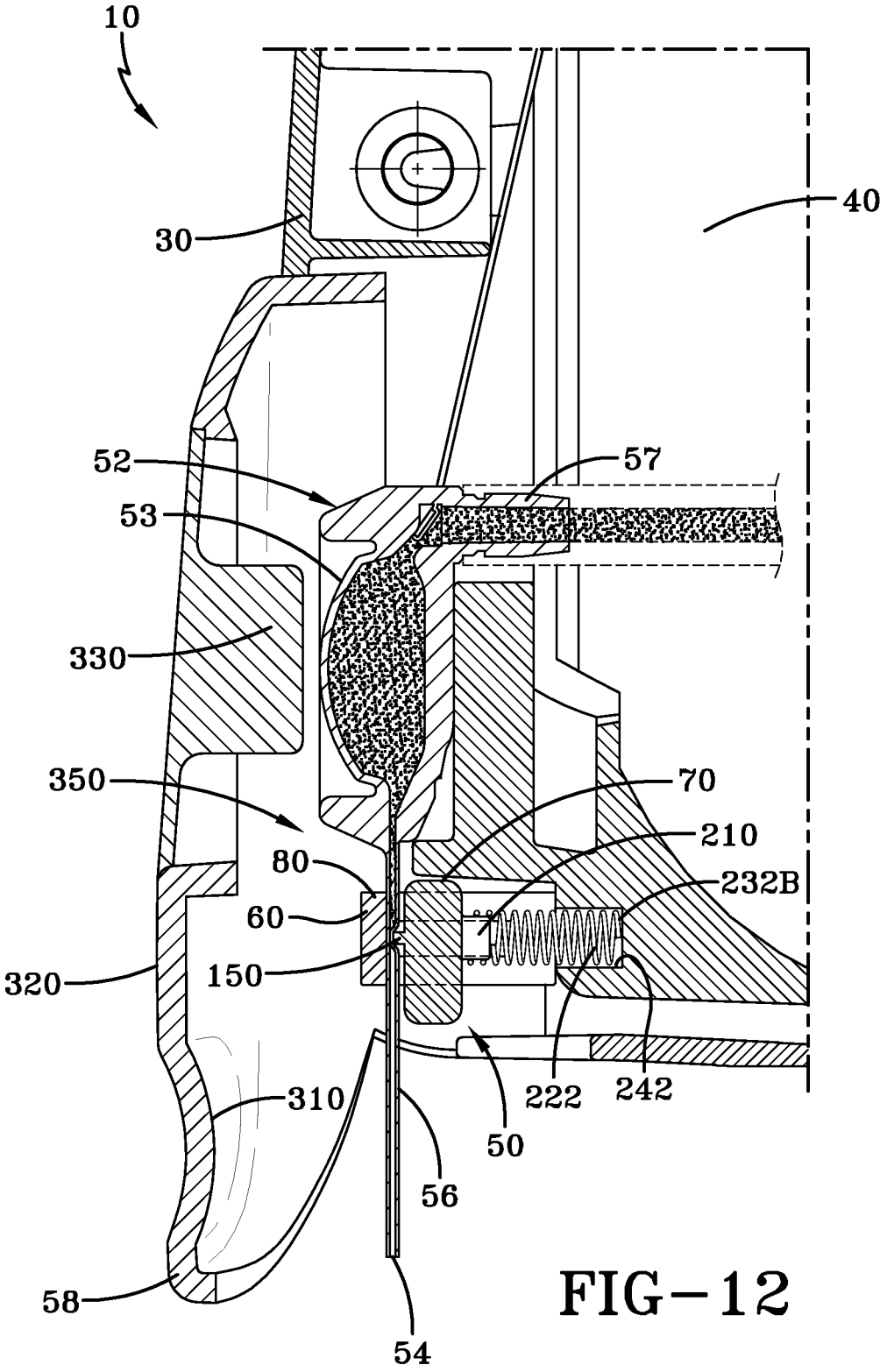
FIG. 12 is an alternative dispenser of FIGS. 1-11, which utilizes a pinch member that is constantly biased against the outlet tube in accordance with the concepts of the present invention.
Figure 13:
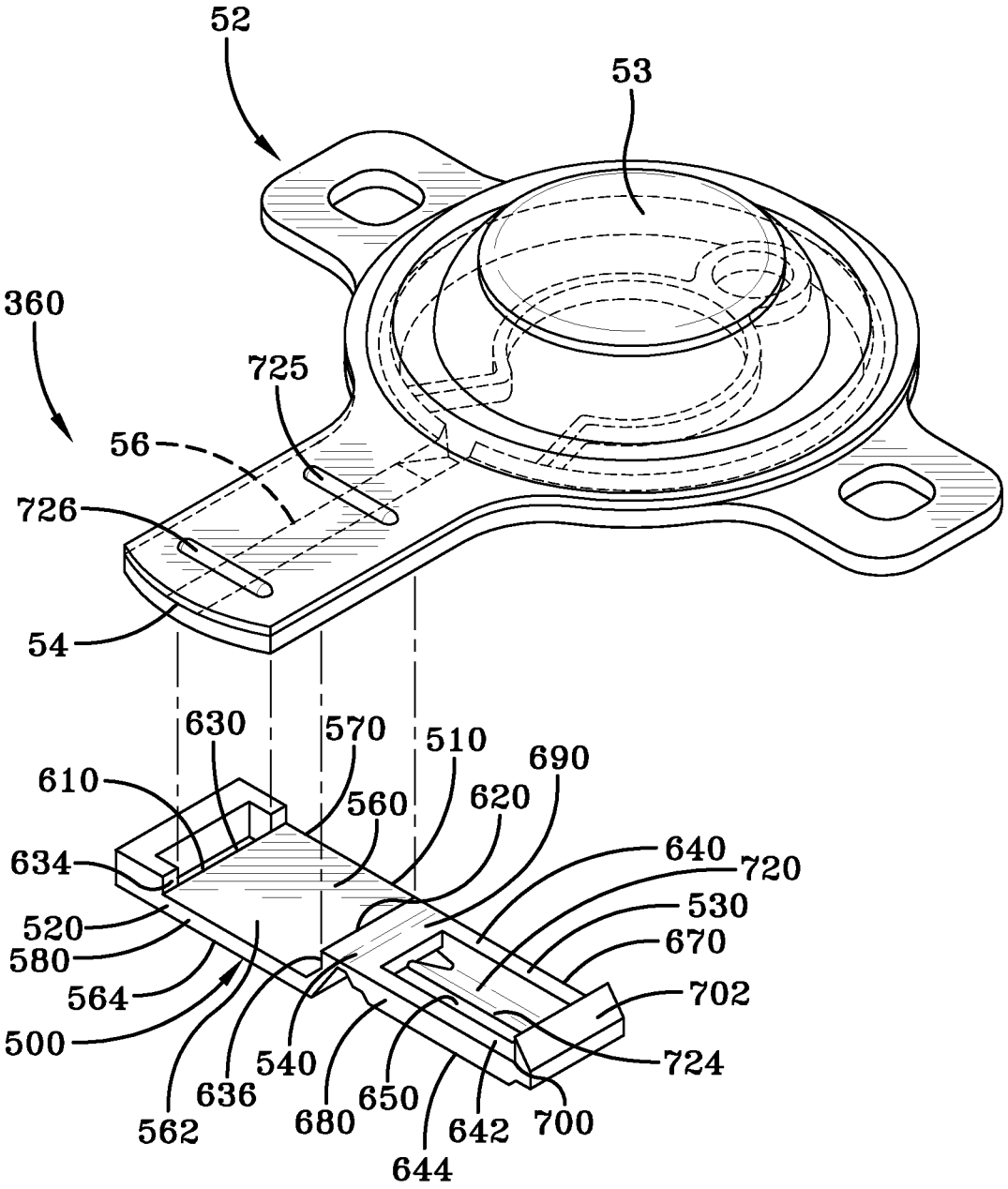
FIG. 13 is a perspective view of an alternative shut-off system that utilizes a clip for attachment to the outlet tube of a pump assembly in accordance with the concepts of the present invention.

In another embodiment, a shut-off system for use with dispenser 10, generally referred to by numeral 350 shown in FIG. 12, is structurally equivalent to the shut-off system 70 previously discussed, with the exception that the lower engagement rib 340 is removed from the actuator 58, allowing the pinch member 70 to apply a constant or continuous biasing force against the outlet tube 56. In other words, the pinch member 70 operates independently of the actuator 58, and as such the pinch member 70 applies a constant amount of biasing force to the outlet tube 56, closing it off, to prevent the drool of any residual material out of the dispensing nozzle 54. However, when the actuator 58 is engaged the upper engagement rib 330 compresses the dome pump 53 pressurizing the material delivered thereto by the refill container 42. The pressurized material counters the biasing force applied to the outlet tube 56 by the pinch member 70, causing the outlet tube 56 to be opened to allow material to be transported therethrough and dispensed from the nozzle 54. Upon the release of the actuator 58, the material is no longer pressurized, allowing the pinch member 70 to return to its normally biased position, so as to close-off the outlet tube 56, and thus prevent the drool of material from the nozzle 54.

Figure 18:
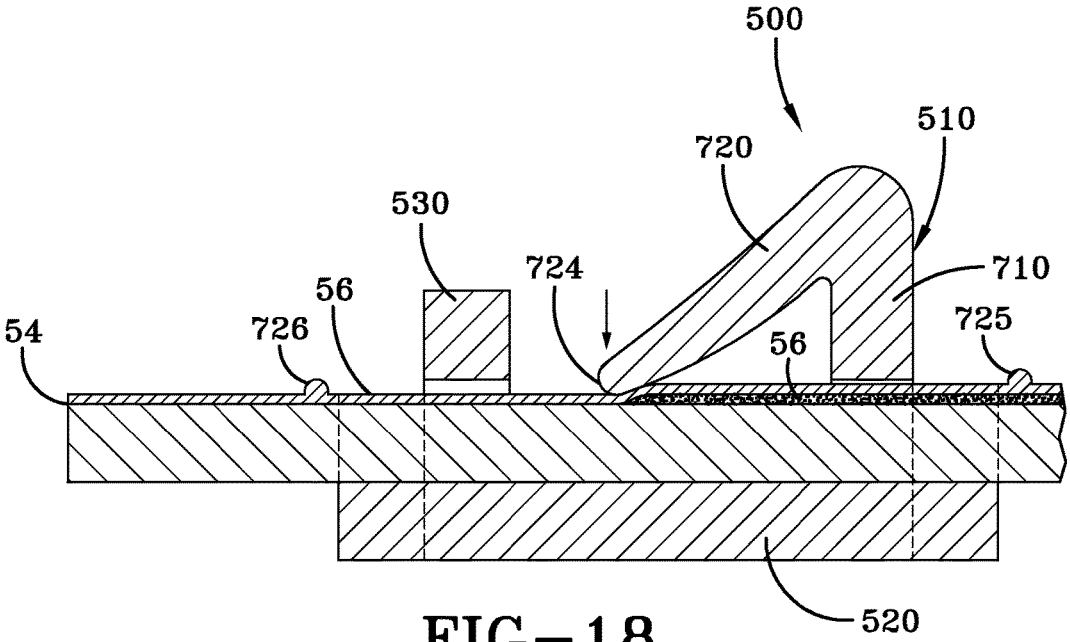
FIG. 18 is a cross-sectional view of the pump assembly showing the clip compressing the outlet tube to prevent the passage of material therethrough in accordance with the concepts of the present invention.
Figure 19:
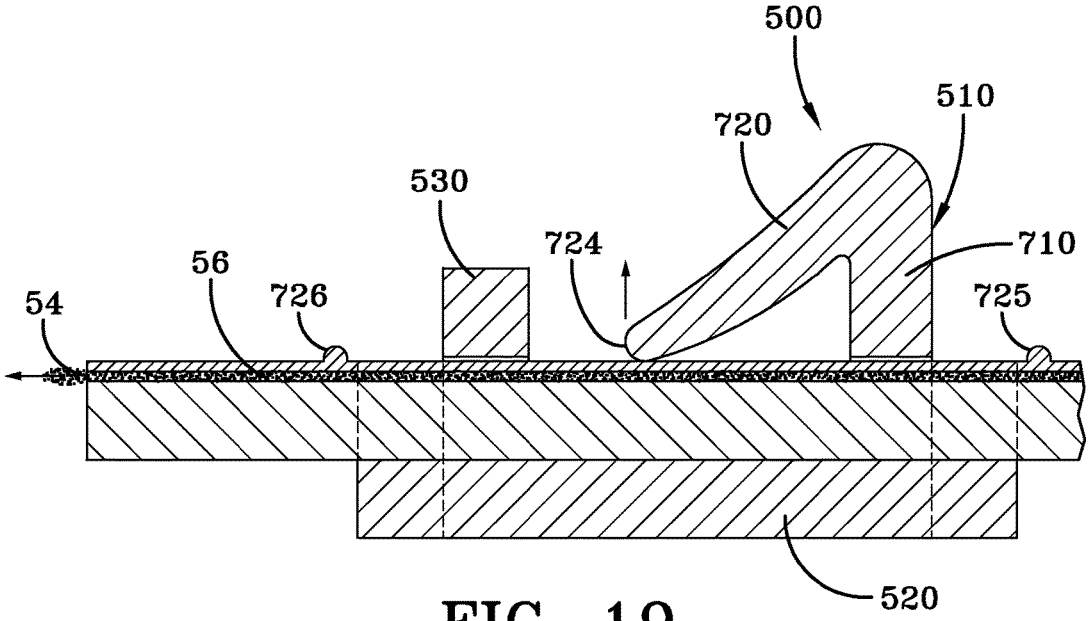
FIG. 19 is a cross-sectional view of the pump assembly showing the clip to allow material to pass therethrough.
Figure 20:
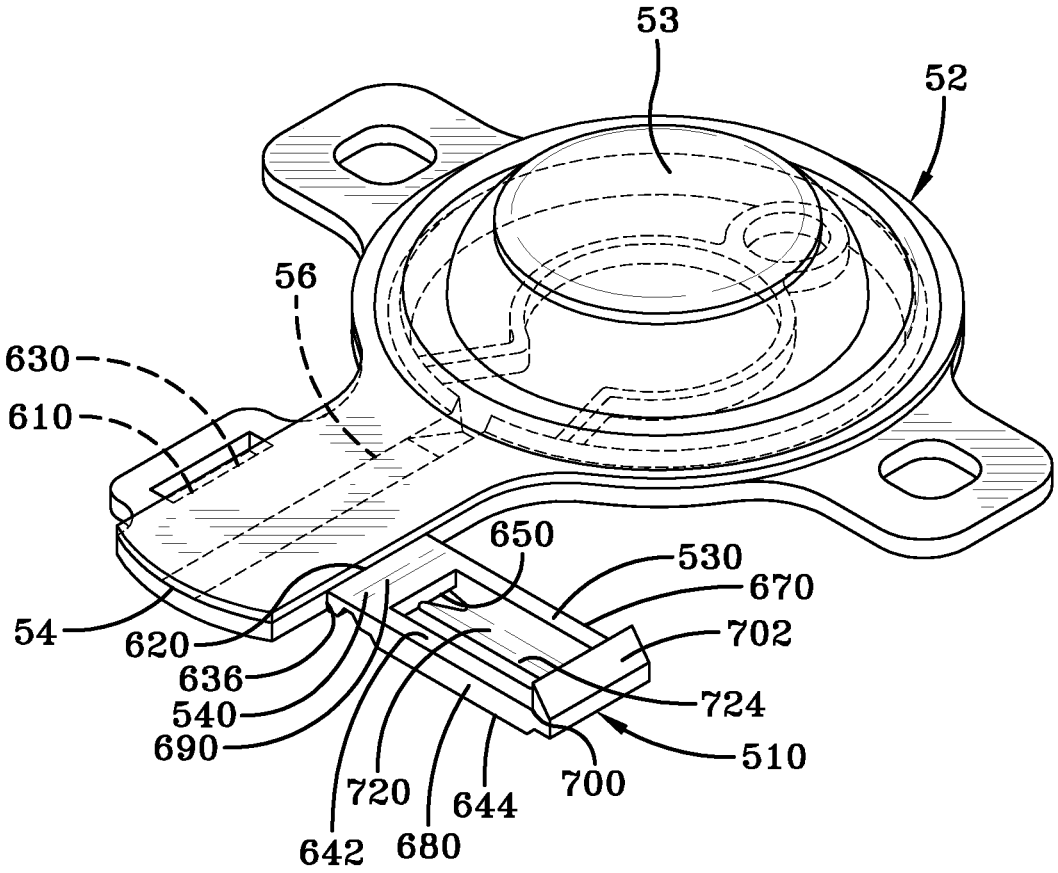
FIG. 20 is a perspective view of another alternative shut-off system in which the clip of FIGS. 13-19 is made integral with the outlet tube of the pump assembly in accordance with the concepts of the present invention.

In yet another embodiment, a shut-off system 360 for use with dispenser 10 comprises a pinch-off assembly 500, as shown in FIGS. 13-20, which may be configured so as to be directly attached to the outlet tube 56 of the pump assembly 52 from which material is dispensed by the operation of the dome pump 53. It should be appreciated that the pinch-off assembly 500 is configured for use with the dispenser 10 in which the actuator 58 does not utilize a lower engagement rib 340. Specifically, the pinch-off assembly 500 comprises a clip 510, shown clearly in FIGS. 13-156, having a base member 520 to which a cap member 530 is pivotably attached by a living hinge 540. The base member 520 comprises a substantially planar section 560 having opposed upper and lower surfaces 562 and 564 that is defined by opposed upper and lower edges 570 and 580, and substantially opposed lateral edges 610 and 620. The base member 520 also includes a lock aperture 630 is disposed at lateral edge 610, which is substantially opposite to lateral edge 620 to which the living hinge 540 is disposed. Extending at a substantially right angle from the upper surface 562 of the base member 520 are spaced walls 634 and 636 that define a retaining channel 638 therebetween, which is dimensioned to receive the dimension of the outlet tube 56 therein. Thus, it should be appreciated that the clip 510 of the pinch-off assembly 500 may be retrofit to an existing dispenser that utilizes the pump assembly 52, as shown in FIGS. 13-19. Alternatively, as shown in FIG. 20, the clip 510 may be made integral with the outlet tube 56 portion of the pump assembly 53, thus forming a single pump assembly with an integrated shut-off system. That is, the base member 520 of the clip 510 may be formed as part of the outlet tube 56, while the cap member 530 is pivotably attached to the outer edge of the outlet tube 56 by the living hinge 540.

The cap member 530 includes a substantially planar section 640 having an opposed inner and outer surface 642 and 644 through which an aperture 650 is disposed. The cap member 530 is defined by upper and lower edges 670 and 680, and opposed lateral edges 690 and 700. Extending from the lateral edge 700 is a tab 702 that is configured to be received within the lock aperture 630 and retained therein when the cap member 530 is closed. Extending from the outer surface 644 of the cap member 530 at a point adjacent to the upper edge 670 at a substantially right angle is an off-set section 710, from which extends an angled sealing arm 720. The sealing arm 720 includes an edge 724 that is configured to contact the outlet tube 56. That is, the sealing arm 720 extends through the aperture 650 at an angle, so as to compress the outlet tube 56 against the base member 520.

Figure 14:
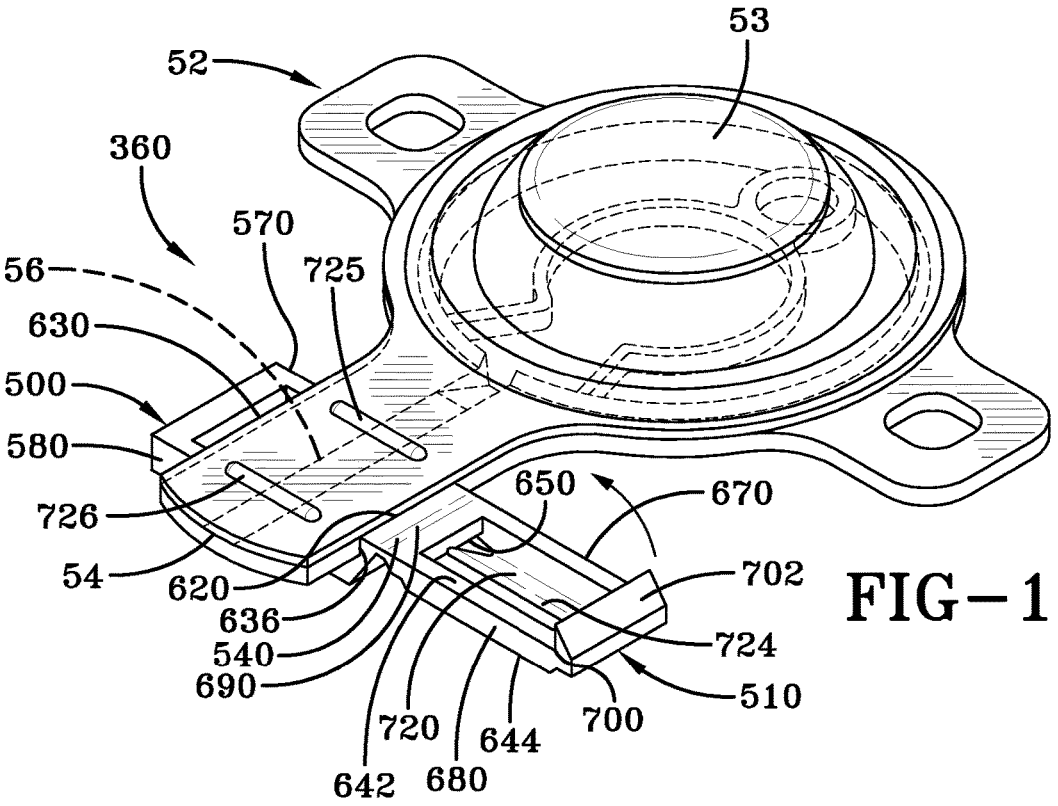
FIG. 14 is a perspective view of the clip unattached to the outlet tube of the dome pump assembly in accordance with the concepts of the present invention.
Figure 15:
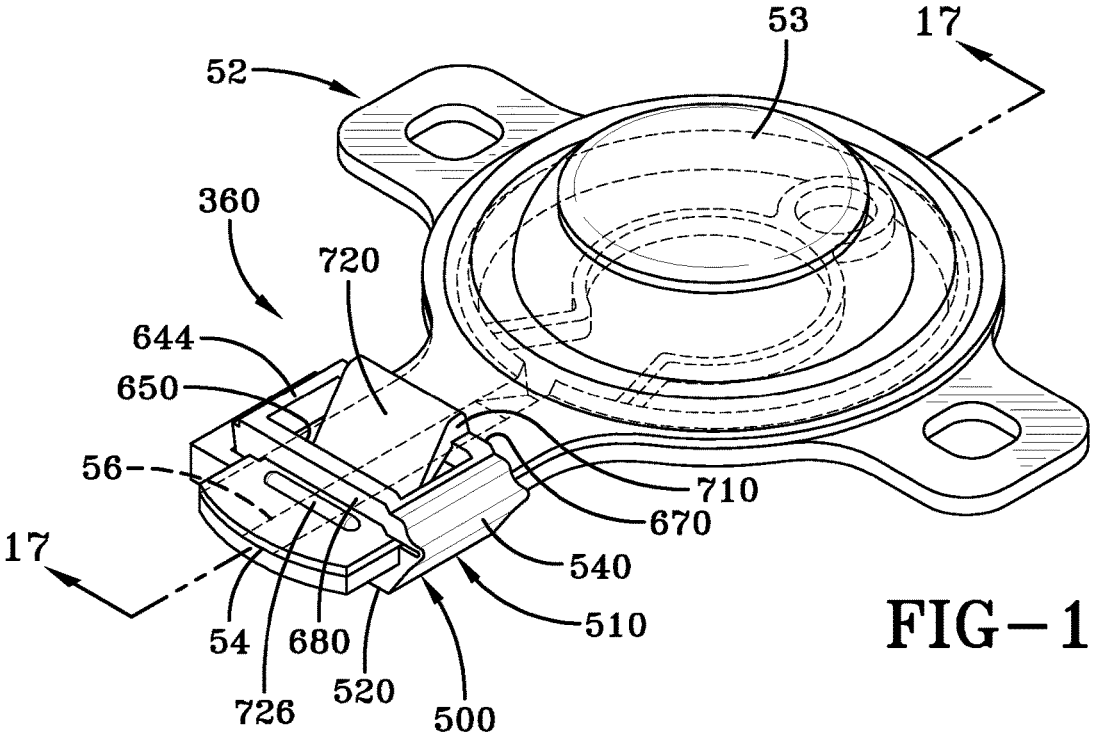
FIG. 15 is a perspective view of the clip attached to the outlet tube of the dome pump assembly in accordance with the concepts of the present invention.
Figure 16:
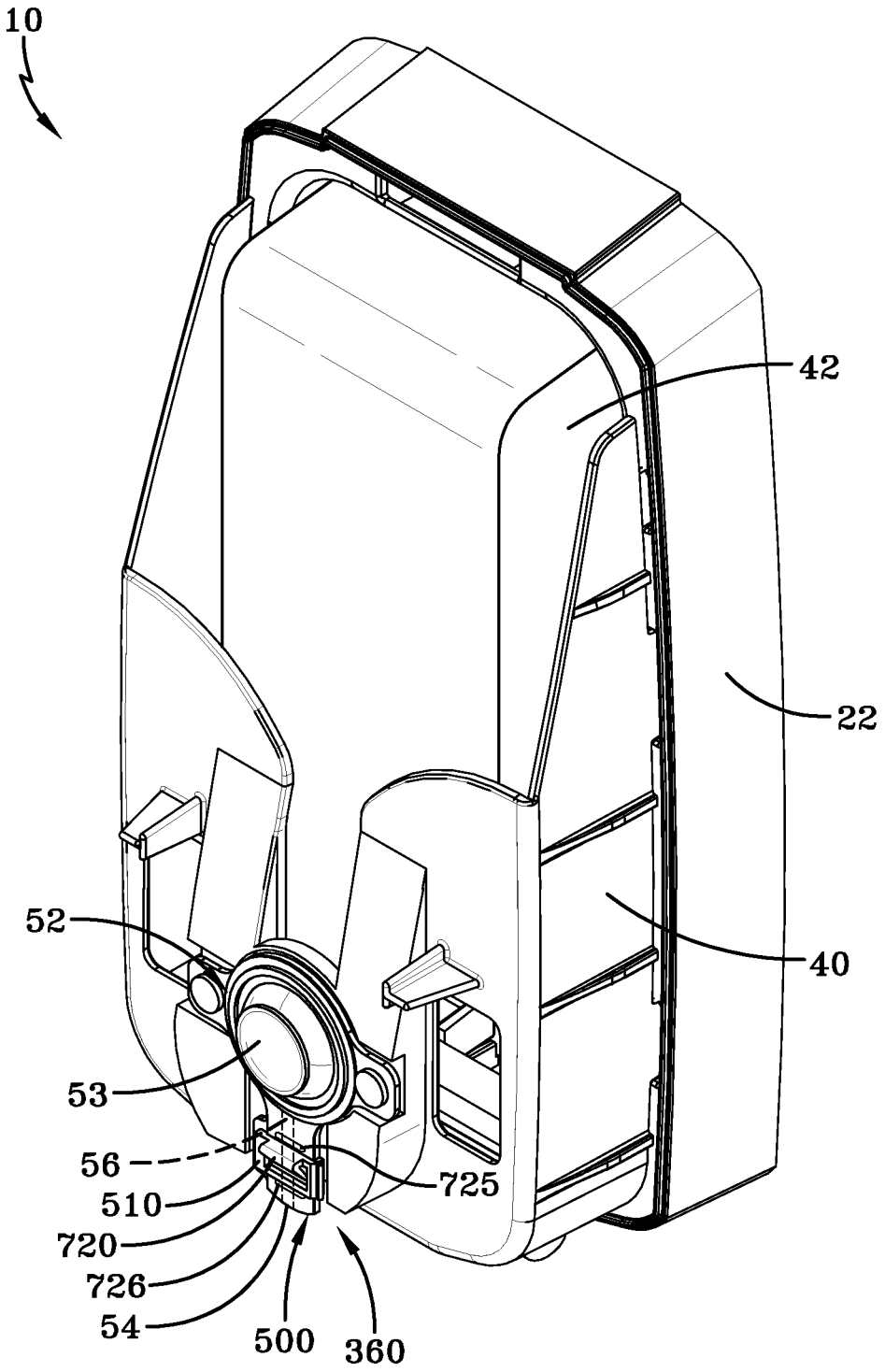
FIG. 16 is a perspective view of the a dispenser including the dome pump and clip in accordance with the concepts of the present invention.
Figure 17:
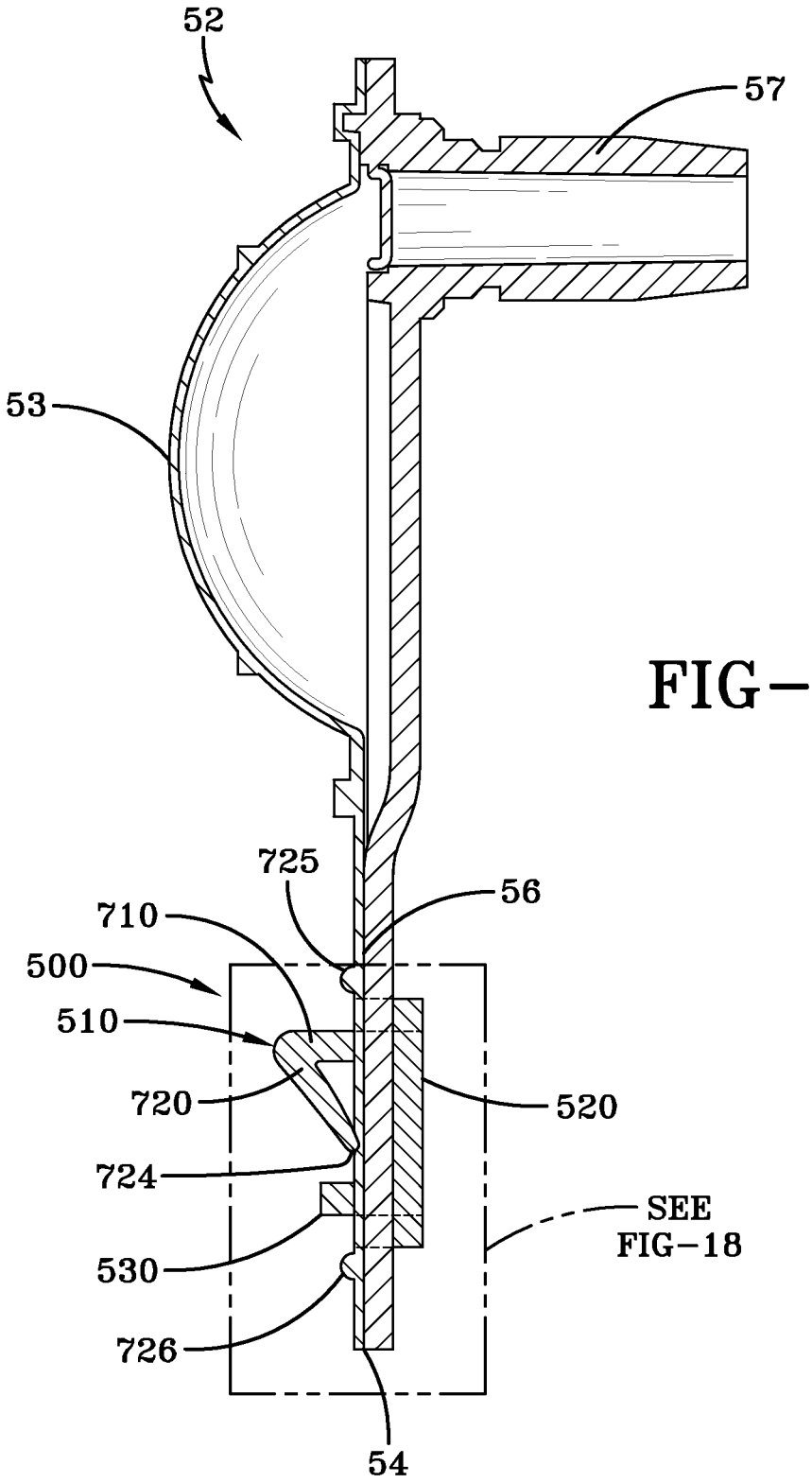
FIG. 17 is a cross-sectional view of the dome pump assembly and the clip attached thereto in accordance with the concepts of the present invention.

Thus, during operation of the dispenser 10 in conjunction with the pinch-off assembly 500, the clip 510 is attached to the pump assembly 52, such that the outlet tube 56 is placed in the retaining channel 638, as shown in FIG. 14. It should be appreciated that in one aspect the outlet tube 56 of the pump assembly 52 may include retention tabs 725,726 that are disposed above and below the clip 510 to prevent the clip 510 from sliding from its desired attachment point along the outlet tube 56. Next, the cap member 530 is rotated via the living hinge 540 so that the tab 702 is received in the lock aperture 630 of the base member 520, thus securing the clip 510 to the outlet tube 56, as shown in FIG. 15. As such, the sealing arm 720 normally applies constant force to the outlet tube 56 so as to keep the outlet tube 56 closed off, preventing the passage of liquid material therethrough, as shown in FIG. 18. However, when the dome pump 53 is compressed by the upper engagement rib 330 upon the engagement of the actuator 58, the material from the refill container 42 is pressurized and urges the sealing arm 720 away from the outlet tube 56 (by expanding the outlet tube 56), as shown in FIG. 19, forcing the outlet tube 56 open, such that material from the refill container 42 is permitted to pass through the outlet tube 56 so that it may be dispensed at the nozzle 54. After the dispensing action is completed, the material is no longer pressurized, allowing the edge 724 of the sealing arm 720 to compress the outlet tube 56 so that the outlet tube 56 returns to its normally closed-off state.

It should also be appreciated that the clip 510 may be formed as a single unified section that does not require the use of the living hinge 540 or the lock tab 702 and lock aperture 630. Thus, such a unified clip 510 would be configured to be slid onto the outlet tube 56 and retained thereon by the force of the sealing arm 720 and by the retention tabs 725,726 extending from the outlet tube 56 and disposed above and below the clip 510, which serve to prevent the clip 510 from sliding from is intended position.

It should also be appreciated that the pinch-off assembly 500 also aids the priming of the pump 53. Specifically, the nozzle 54 is configured to allow for fluid from the refill container 42 to be drawn in through the inlet 57 by the relaxation of the dome pump 53 as it transitions from a compressed state to its non-compressed state (i.e. normal state). The dome pump 53 relies on this ability to return back to its original shape after being compressed in order to create a vacuum at the inlet 57 to thereby draw in fluid from the refill container 42. Furthermore, in order to provide the proper conditions for the pump 53 to draw in material from the refill container 42, the outlet nozzle 54 is also required to remain restricted by operation of the clip 510 at the same time the pump 53 is returning from its compressed state to ensure material from the refill container 40 is drawn into the pump, while preventing air from being drawn in.

Figure 21:
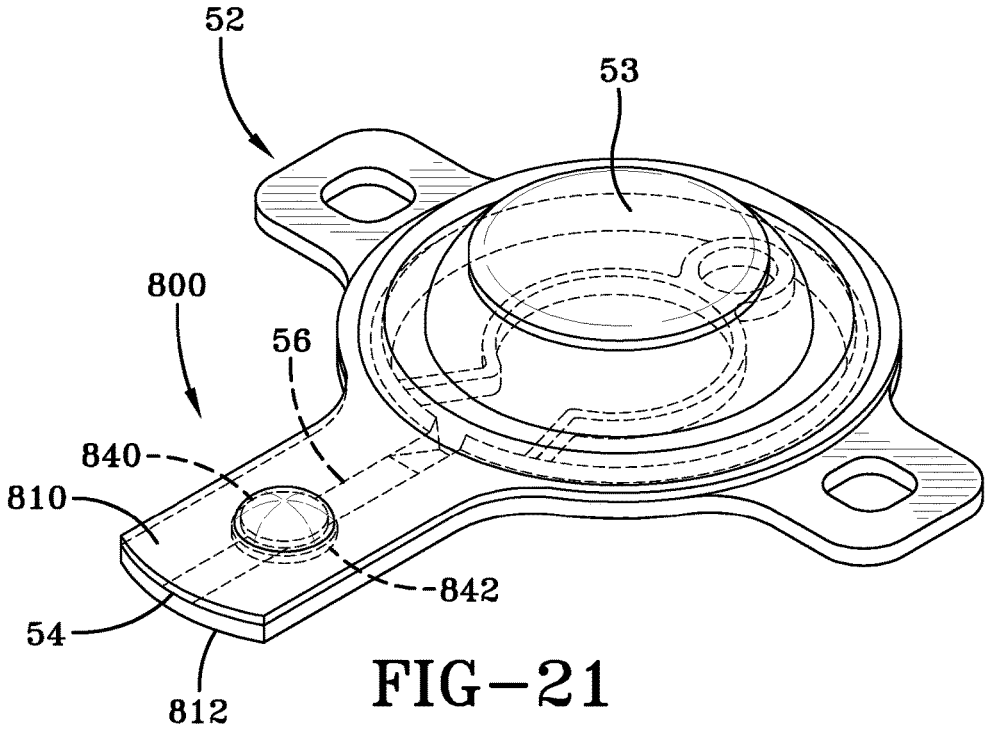
FIG. 21 is a perspective view of an another alternative shut-off system in which a ferromagnetic section and a magnetic section are made integral with the pump assembly to prevent the drooling of material out of the dispensing nozzle in accordance with the concepts of the present invention.
Figure 22:
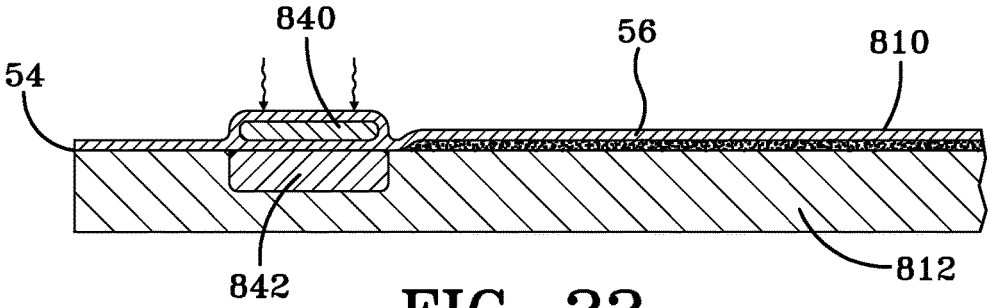
FIG. 22 is a cross-sectional view of the alternative shut-off system of FIG. 21 showing the outlet tube placed in a closed position in accordance with the concepts of the present invention.
Figure 23:
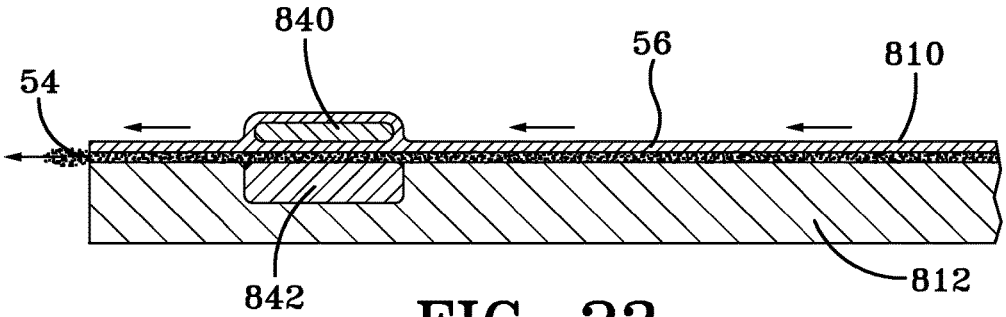
FIG. 23 is a cross-sectional view of the alternative shut-off system of FIG. 21 showing the outlet tube in an open position in accordance with the concepts of the present invention.

In another embodiment, a shut-off system for use with dispenser 10, generally referred to by numeral 800, is shown in FIGS. 21-23 of the drawings. In particular, the shut-off system 800 utilizes the pump assembly 52, as previously discussed, whereby the outlet tube 56, which extends from the pump 53, is formed of a laminated upper section 810 and lower section 812 of material, such as compressible plastic or any other suitable compressible polymeric material. Disposed in the upper section 810 is a ferromagnetic section 840, such as iron, steel, or any other magnetically-attracted material, while a magnetic section 842, such as a magnet, is disposed in the lower laminated section 812. As such, the ferromagnetic section 840 and the magnetic section 842 are substantially aligned with each other. As such, the magnetic section 842 and the ferromagnetic section 840 are oriented so that they are attracted to each other, thus causing the outlet tube 56 to be normally compressed, as shown in FIG. 22, thereby preventing material in the pump 53 from drooling or leaking out of the nozzle 54 when the dispenser 10 is not in use. During operation, when the actuator 58 is engaged by the user to dispense material, the material is pressurized by the compression of the dome pump, which overcomes the attractive forces between the magnetic section 842 and the ferromagnetic section 840, allowing the outlet tube 56 to open, so as to dispense material from the nozzle 54, as shown in FIG. 23.

Figure 24:
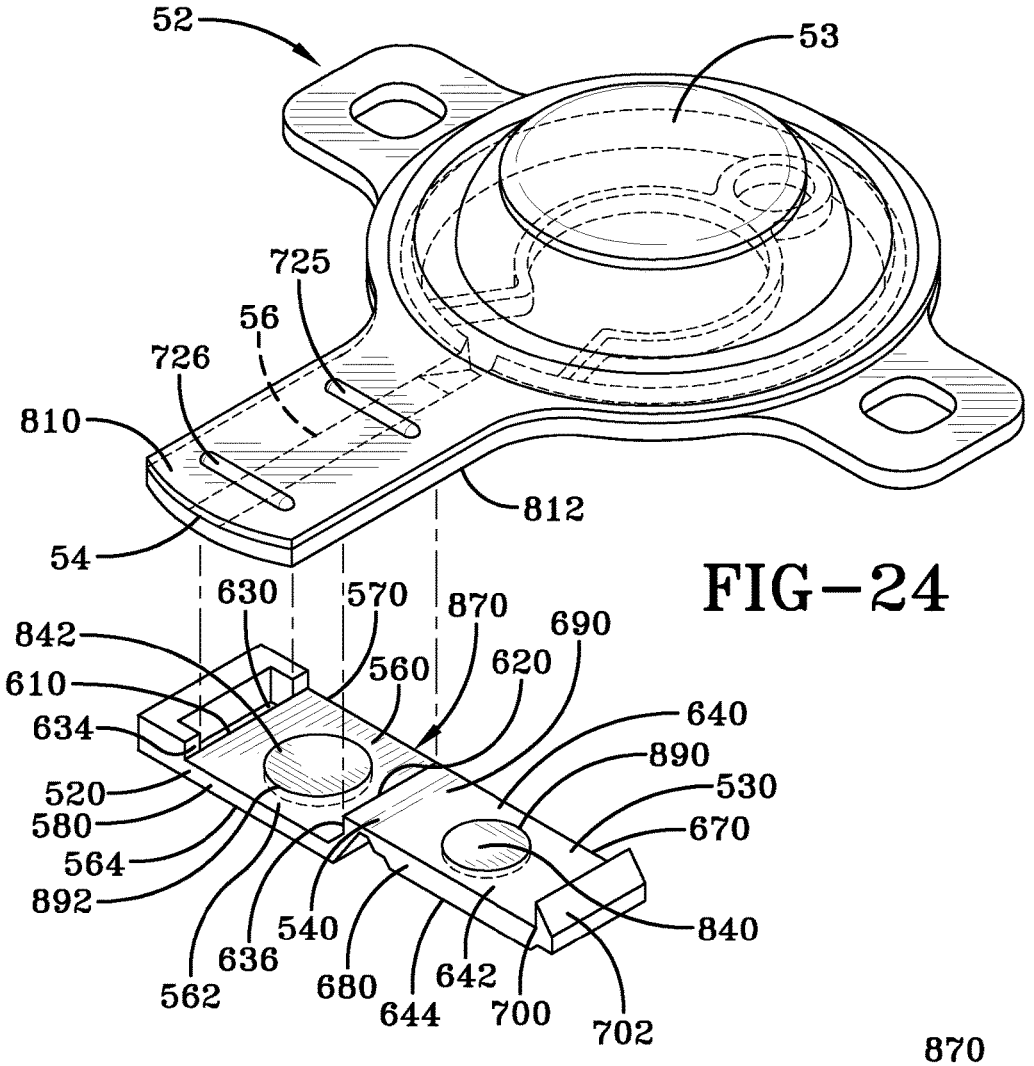
FIG. 24 is an exploded view of another alternative shut-off system that utilizes a removable clip having a ferromagnetic section and a magnetic section configured to be disposed on either side of the outlet tube in accordance with the concepts of the present invention.
Figure 25:
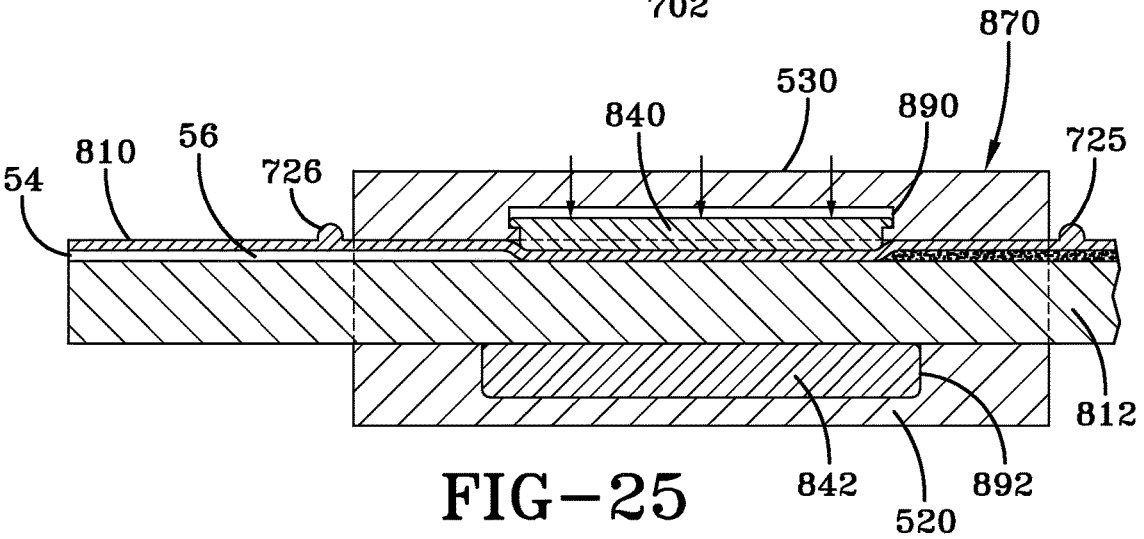
FIG. 25 is a cross-sectional view of the alternative shut-off system of FIG. 24 in accordance with the concepts of the present invention.

Alternatively, the magnetic section 842 and the ferromagnetic section 840 may be configured so that they are carried by a removable clip 870, as shown in FIGS. 24-25. It should be appreciated that the clip 870 is structurally equivalent to clip 510 previously discussed, with the exception that clip 870 of the instant embodiment does not include an aperture 650 and sealing arm 720, and is configured such that the magnetic section 842 is disposed in the base member 520 and the ferromagnetic section 840 is disposed in the cap member 530. Thus, the clip 870 provides a convenient manner for attachment to the outlet tube 56 and is configured to normally close the outlet tube 56 to prevent drooling of the material from the nozzle 54 when the dispenser 10 is not in use, while allowing the outlet tube 56 to be opened (by the pressurized material) to allow the passage of material through the outlet tube 56 when the pump 53 is compressed. In one aspect, the ferromagnetic section 840 and magnetic section 842 may be slideably retained or housed in the clip 870 via respective apertures 890 and 892, such that when the clip 870 is attached about the outlet tube 56, the ferromagnetic and magnetic sections 840,842 are able to apply direct force to the outlet tube 56 (via their attractive forces) to compress or close it off. Alternatively, when the pump 53 is compressed, the pressurized material to be dispensed expands the outlet tube 56 and slides the ferromagnetic section 840 and/or magnetic section 842 into its respective aperture 890,892 to allow the outlet tube 56 to open for the passage of material therethrough.

It will, therefore, be appreciated that one advantage of one or more embodiments of the present invention is that a shut-off system prevents residual material contained in an outlet tube from drooling out of the dispensing nozzle of the dispenser. Another advantage of the present invention is that a shut-off system for a dispenser is low cost. Yet another advantage of the present invention is that a shut-off system for a dispenser prevents the waste of material provided by the dispenser when it is not in use. Still another advantage of the present invention is that a shut-off system for a dispenser aids in the priming of the pump assembly used by the dispenser.

Although the present invention has been described in considerable detail with reference to certain embodiments, other embodiments are possible. Therefore, the spirit and scope of the appended claims should not be limited to the description of the embodiments contained herein.

What is claimed is:

1. A dispenser to dispense material comprising:
- a pump having an inlet adapted to receive material, and an outlet;
- an outlet tube in fluid communication with the outlet, the outlet tube extending in a first direction and having an outlet nozzle; and
- a clip comprising:
  - a base member;
  - a cap member having a top surface extending in the first direction and lying within a plane, wherein at least one of:
    - the base member is movable relative to the cap member between an opened position and a closed position, or
    - the cap member is movable relative to the base member between the opened position and the closed position; and
  - a sealing arm extending from the cap member, a first portion of the sealing member lying on a first side of the plane, and a second portion of the sealing member lying on a second side of the plane, wherein:
    - in the closed position the clip is disposed relative to the outlet tube such that the sealing arm applies a first force to the outlet tube in a direction from the cap member toward the base member, the first force sufficient to compress the outlet tube; and
    - in the opened position the clip is disposed relative to the outlet tube such that the sealing arm does not apply a force to the outlet tube sufficient to compress the outlet tube;
- wherein when the pump is compressed, the material is urged through the outlet tube in a direction from the outlet toward the outlet nozzle at a second force sufficient to overcome the first force to allow the material to be dispensed through the outlet nozzle.

2. The dispenser of claim 1, wherein the cap member is pivotably joined to the base member.

3. The dispenser of claim 1, wherein the base member includes a lock aperture, and the cap member includes a tab to be received within the lock aperture to retain the cap member to the base member.

4. The dispenser of claim 1, wherein the clip is removable from the outlet tube.

5. The dispenser of claim 1, wherein the clip is integral with the outlet tube.

6. The dispenser of claim 1, wherein the outlet tube includes at least one retention tab in operative engagement with the clip to prevent the clip from sliding along the outlet tube.

7. The dispenser of claim 1, wherein the base member and the cap member are attached to one another by a living hinge.

8. A dispenser to dispense material comprising:
- a pump having an inlet adapted to receive material, and an outlet;
- an outlet tube in fluid communication with the outlet, the outlet tube having an outlet nozzle; and
- a clip comprising:
  - a base member; and
  - a cap member comprising:
    - an upper edge wall;
    - a lower edge wall spaced apart from the upper edge wall;
    - a first lateral edge wall attached to the upper edge wall and the lower edge wall; and a second lateral edge wall attached to the upper edge wall and the lower edge wall, the second lateral edge wall spaced apart from the first lateral edge wall, the lower edge wall extending between the first lateral edge wall and the second lateral edge wall, wherein at least one of:

the base member is movable relative to the cap member between an opened position and a closed position, or the cap member is movable relative to the base member between the opened position and the closed position, wherein:

in the closed position the clip is disposed relative to the outlet tube such that a first force is applied to the outlet tube in a direction from the cap member toward the base member, the first force sufficient to compress the outlet tube; and in the opened position the clip is disposed relative to the outlet tube such that the clip does not apply a force to the outlet tube sufficient to compress the outlet tube;

wherein when the pump is compressed, the material is urged through the outlet tube in a direction from the outlet toward the outlet nozzle at a second force sufficient to overcome the first force to allow the material to be dispensed through the outlet nozzle.

9. The dispenser of claim 8, wherein the base member and the cap member are attached to one another by a living hinge.

10. The dispenser of claim 8, wherein the lower edge wall extends continuously between the first lateral edge wall and the second lateral edge wall.

11. The dispenser of claim 10, wherein the upper edge wall, the lower edge wall, the first lateral edge wall, and the second lateral edge wall define an aperture extending through the cap member.

12. The dispenser of claim 11, wherein the clip comprises a sealing arm attached to the upper edge wall and extending into the aperture, the sealing arm surrounded by the upper edge wall, the lower edge wall, the first lateral edge wall, and the second lateral edge wall and configured to apply the first force to the outlet tube.

13. The dispenser of claim 8, wherein the outlet tube comprises a first retention tab and a second retention tab projecting outwardly from an outer surface of the outlet tube, the first retention tab spaced apart from the second retention tab to define a space.

14. The dispenser of claim 8, wherein, in the closed position, the base member extends parallel to the cap member.

15. A dispenser to dispense material comprising:

a pump having an inlet adapted to receive material, and an outlet;

an outlet tube in fluid communication with the outlet, the outlet tube having an outlet nozzle, the outlet tube comprising a first retention tab and a second retention tab projecting outwardly from an outer surface of the outlet tube, the first retention tab spaced apart from the second retention tab to define a space; and a clip comprising:

a base member comprising:

a first wall; and a second wall spaced apart from the first wall to define a retaining channel configured to receive the outlet tube;

a cap member attached to the base member, the cap member comprising:

an upper edge wall;

a lower edge wall spaced apart from the upper edge wall;

a first lateral edge wall attached to the upper edge wall and the lower edge wall; and a second lateral edge wall attached to the upper edge wall and the lower edge wall, the second lateral edge wall spaced apart from the first lateral edge wall; and a sealing arm attached to the upper edge wall;

wherein when the outlet tube is received within the retaining channel between the first wall and the second wall and the cap member is attached to the base member a first force is applied to the outlet tube by the sealing arm in a direction from the cap member toward the base member, the first force sufficient to compress the outlet tube, and wherein the cap member is received within the space between the first retention tab and the second retention tab such that the first retention tab and the second retention tab limit movement of the clip relative to the outlet tube, the first retention tab adjacent to the upper edge wall and the second retention tab adjacent to the lower edge wall, the lower edge wall disposed between the sealing arm and the second retention tab;

wherein when the pump is compressed, the material is urged through the outlet tube in a direction from the outlet toward the outlet nozzle at a second force sufficient to overcome the first force to allow the material to be dispensed through the outlet nozzle.

16. The dispenser of claim 15, wherein the lower edge wall extends between the first lateral edge wall and the second lateral edge wall.

17. The dispenser of claim 16, wherein the upper edge wall, the lower edge wall, the first lateral edge wall, and the second lateral edge wall define an aperture extending through the cap member.

18. The dispenser of claim 17, wherein the sealing arm extends into the aperture.

19. The dispenser of claim 15, wherein the upper edge wall is disposed between the sealing arm and the first retention tab.

20. The dispenser of claim 15, wherein a first portion of the sealing arm extends in a direction away from the outlet tube.

* * * * *